US011704959B2

(12) United States Patent
Ihara et al.

(10) Patent No.: US 11,704,959 B2
(45) Date of Patent: Jul. 18, 2023

(54) SHEET PROCESSING SYSTEM, SHEET PROCESSING METHOD, AND DECISION APPARATUS

(71) Applicant: Glory Ltd., Himeji (JP)

(72) Inventors: Wataru Ihara, Hyogo (JP); Kazuya Nishino, Hyogo (JP)

(73) Assignee: GLORY LTD., Himeji (JP)

( * ) Notice: Subject to any disclaimer, the term of this patent is extended or adjusted under 35 U.S.C. 154(b) by 161 days.

(21) Appl. No.: 17/220,932

(22) Filed: Apr. 2, 2021

(65) Prior Publication Data

US 2021/0327200 A1 Oct. 21, 2021

(30) Foreign Application Priority Data

Apr. 15, 2020 (JP) ..... 2020-073096

(51) Int. Cl.
*G07D 11/50* (2019.01)
*G07D 11/23* (2019.01)
*G07D 11/12* (2019.01)

(52) U.S. Cl.
CPC ..... *G07D 11/50* (2019.01); *G07D 11/12* (2019.01); *G07D 11/23* (2019.01)

(58) Field of Classification Search
CPC ..... G07D 11/50; G07D 11/12; G07D 11/23
See application file for complete search history.

(56) References Cited

U.S. PATENT DOCUMENTS

2010/0168902 A1* 7/2010 Mizushima ..... G07D 11/23 194/215
2018/0330563 A1* 11/2018 Yuasa ..... G07F 19/20
2019/0066429 A1* 2/2019 Okuma ..... G07D 11/34
2022/0189233 A1* 6/2022 Takahashi ..... B65H 7/02

FOREIGN PATENT DOCUMENTS

WO 2008/152684 A1 12/2008

* cited by examiner

*Primary Examiner* — Sonji N Johnson
(74) *Attorney, Agent, or Firm* — Xsensus LLP

(57) ABSTRACT

A sheet processing system, comprising a storage device that stores one or more sheets, and control circuitry. The control circuitry is configured to count a number of sheets stored in the storage device; determine whether the storage device is full based on a storage state of the storage device; in a case that the storage device is determined to be full, decide a set value relating to an upper limit number of the sheets storable in the storage device by using a plurality of count results from the control circuitry; and set the set value for the storage device.

19 Claims, 9 Drawing Sheets

SHEET PROCESSING SYSTEM, SHEET PROCESSING METHOD, AND DECISION APPARATUS

CROSS-REFERENCE TO RELATED APPLICATION

This application claims priority to Japanese Patent Application No. 2020-073096, filed on Apr. 15, 2020, the entire disclosure of which is incorporated herein by reference.

TECHNICAL FIELD

The present disclosure relates to a sheet processing system, a sheet processing method, and a decision apparatus for performing processing relating to storage of sheets.

BACKGROUND

A sheet processing apparatus for receiving, recognizing, and storing sheets in a storage unit is becoming pervasive. As an example of the storage unit, there is a storage unit in which sheets are stacked and stored.

When the sheets are stored in excess of the physical capacity of the storage unit, the sheets may be damaged or the storage unit may be broken due to excessive storage. In order to avoid such a situation, the sheet processing apparatus which stops storing sheets into the storage unit once the storage unit becomes full has been developed.

As a method of detecting that the storage unit is full, there is a method of determining whether or not the number of sheets stored in the storage unit reaches a set value of a predetermined upper limit number of sheets. The set value of the upper limit number of sheets is set with a certain margin based on, for example, the number of sheets stored at a point in time when the storage unit becomes actually full.

However, the degree of fatigue and the manner of deflection are different even for the same type of sheet. As the quantity of wrinkles and bends increases, the gap between the sheets increases when a plurality of sheets are stacked, and thus the number of sheets storable in the storage unit substantially decreases. Such a case may cause lack of physical space for storing the sheets in the storage unit before the number of the sheets stored in the storage unit reaches the set value.

On the contrary, in a case of new series notes with few wrinkles or bends, the gaps between the sheets are relatively small even when a plurality of sheets are stacked. Therefore, the number of sheets storable in the storage unit relatively increases. In such a case, even when the sheets stored in the storage unit reaches the upper limit number, the physical space for storing the sheets may be left in the storage unit.

Therefore, a method of setting the set value to an appropriate value is required. A conventional process of detecting whether or not the storage is full is performed by detecting the size or weight of the currency group stored in the storage, and correcting the storage limit amount corresponding to the set value of the upper limit number of sheets to the actual storage amount when it is detected that the storage is full.

SUMMARY

A sheet processing system according to the present disclosure comprises a storage device that stores one or more sheets, and control circuitry. The control circuitry is configured to count a number of sheets stored in the storage device; determine whether the storage device is full based on a storage state of the storage device; in a case that the storage device is determined to be full, decide a set value relating to an upper limit number of the sheets storable in the storage device by using a plurality of count results from the control circuitry; and set the set value for the storage device.

DETAILED DESCRIPTION OF THE DRAWINGS

It is an object of the present disclosure to provide a sheet processing system, a sheet processing method, and a decision apparatus capable of setting a set value relating to an upper limit number to a more appropriate value.

According to the present disclosure, the set value relating to the upper limit number of sheets can be set to the more appropriate value.

Hereinafter, embodiments of the present disclosure will be described in detail with reference to the drawings. However, there are cases where a more detailed description than necessary, for example, a detailed description of already well-known matters, a duplicated description of substantially the same configuration, and the like are omitted. Also, the following description and referenced drawings are provided to the person skilled in the art in order to understand the subject matter and are not intended to limit the scope of the claims.

Hereinafter, a banknote processing apparatus 1 as an embodiment of the sheet processing system of the present disclosure will be described. That is, the banknote processing apparatus 1 of the embodiment described below is an example of the sheet processing system of the present disclosure. The banknote processing apparatus 1 is installed in a financial institution such as a bank, for example. In addition to being installed in the financial institution, the banknote processing apparatus 1 can also be installed and used in a back office of a retail store or the like. The banknote processing apparatus 1 is an apparatus that executes various processing containing deposit processing and withdrawal processing. In the embodiment described below, a case in which a banknote is used as an example of a sheet will be described, however, the sheet of the present disclosure may also contain a negotiable security such as a check, for example.

(Overall Configuration of Banknote Processing Apparatus)

Figure 1:
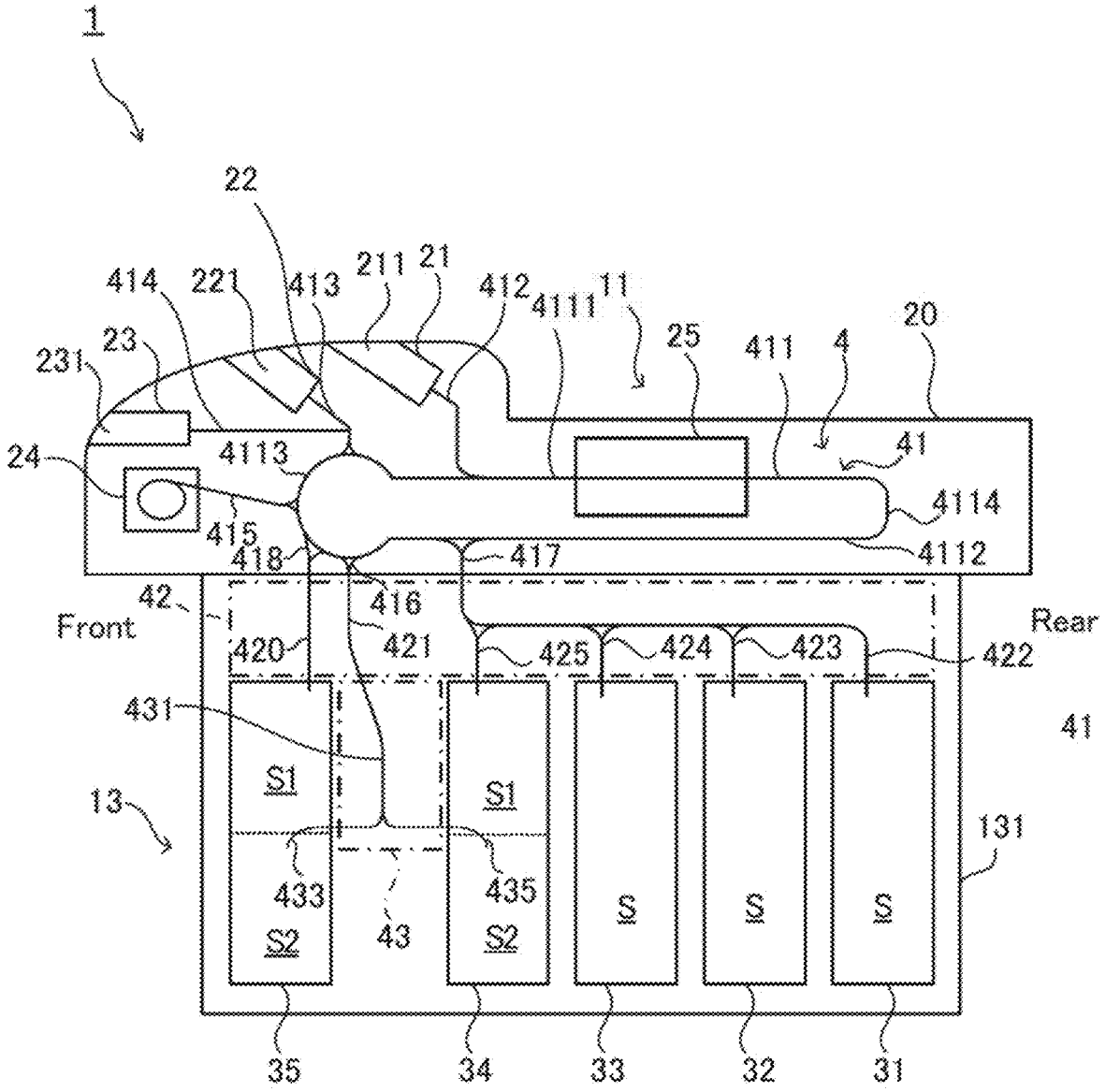
FIG. 1 is a diagram conceptually illustrating an internal structure of a banknote processing apparatus.
Figure 2:
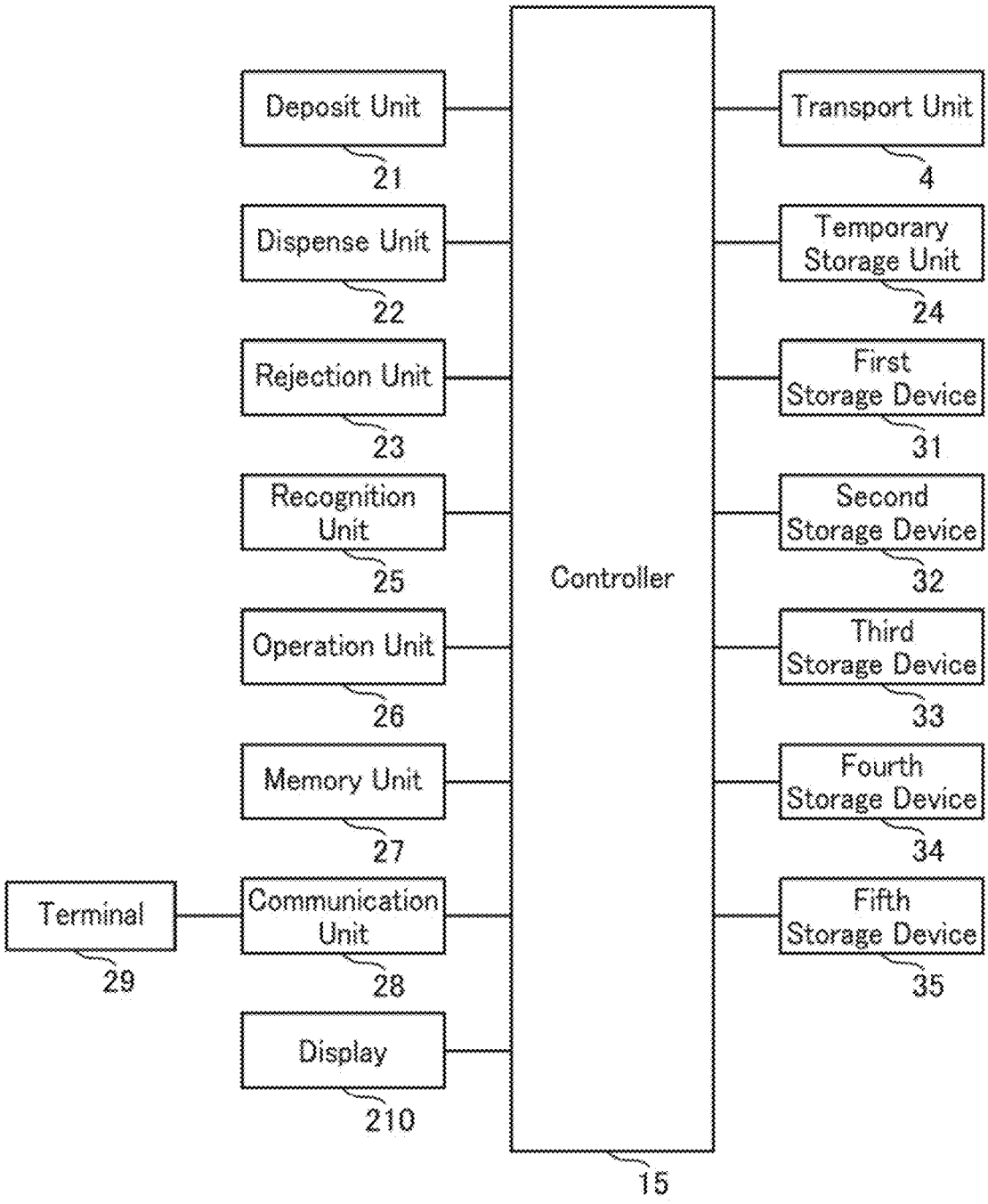
FIG. 2 is a block diagram illustrating a configuration of the banknote processing apparatus.

FIG. 1 conceptually illustrates the internal structure of the banknote processing apparatus 1. FIG. 2 is a block diagram illustrating the configuration of the banknote processing apparatus 1. The banknote processing apparatus 1 has a shape elongated in the front-rear direction. The front of the banknote processing apparatus 1 indicates a portion where an inlet 211 and an outlet 221, which will be described later, are formed. The rear of the banknote processing apparatus 1 indicates a portion opposite to the portion where the inlet 211 and the outlet 221 are formed.

The banknote processing apparatus 1 executes the processing of the banknote. The banknote processing apparatus 1 comprises a processing unit 11 in the upper side, and a safe unit 13 in the lower side. The processing unit 11 is configured with an upper housing 20. In the upper housing 20, a deposit unit 21, a dispense unit 22, a rejection unit 23, a temporary storage unit 24, a recognition unit 25, and, an upper transport unit 41 is disposed. The upper transport unit 41 is a part of a transport unit 4.

The safe unit 13 is configured with a safe housing 131. A plurality of storage devices 31 to 35, a lower transport unit 42, and a second lower transport unit 43 are disposed in the safe housing 131. The lower transport unit 42 and the second lower transport unit 43 are a part of the transport unit 4. The safe housing 131 protects the storage devices 31 to 35 at a security level equal to or higher than a predetermined level. Specifically, the safe housing 131 is formed of a metal plate having a predetermined thickness or more. The security level of the safe housing 131 is higher than that of the upper housing 20.

The deposit unit 21 is a part into which a banknote to be deposited is inserted in the deposit processing, for example. In addition, the deposit unit 21 may be a unit into which a banknote to be counted is inserted in the count processing to be described later. The deposit unit 21 comprises the inlet 211. The inlet 211 opens upward at the front of the upper housing 20. An operator inserts the banknote by hand into the deposit unit 21 through the inlet 211. The deposit unit 21 can hold a plurality of banknotes in a stacked state. The deposit unit 21 comprises a mechanism for taking the banknotes one by one into the banknote processing apparatus 1.

The dispense unit 22 is a part to which the banknote fed out from the storage device are transported, for example, in the withdrawal processing. The dispense unit 22 is also used as a part to which a rejected banknote to be generated in the deposit processing is transported. The dispense unit 22 is also used as a part to which a normal banknote counted in the count processing described later is transported. The dispense unit 22 can hold a plurality of banknotes in a stacked state. The dispense unit 22 comprises the outlet 221. The outlet 221 opens upward at a position in front of the inlet 211. The operator can take out the banknote accumulated in the dispense unit 22 by hand through the outlet 221. A shutter for opening and closing may be disposed at the outlet 221.

The rejection unit 23 is a part to which the banknote to be rejected generated in the count processing is transported, for example. The rejection unit 23 is disposed in the front of the upper housing 20. The rejection unit 23 is configured to hold a plurality of banknotes in a stacked state. The rejection unit 23 comprises a second outlet 231. The second outlet 231 opens forward at the front unit of the upper housing 20. A shutter is provided in the second outlet 231. When the shutter is opened, the operator can take out the banknote accumulated in the rejection unit 23 by hand through the second outlet 231.

The temporary storage unit 24 temporarily stores the banknote to be deposited, for example, at the time of deposit processing. The temporary storage unit 24 can feed out the stored banknote. The temporary storage unit 24 is disposed in a forward position of the upper housing 20. The temporary storage unit 24 is disposed below the rejection unit 23. The temporary storage unit 24 is a tape-type storage unit. The temporary storage unit 24 stores the banknote by winding the banknote on the drum together with the tape. The tape-type storage unit has an advantage that the order of the banknotes is not changed when the banknotes are stored and when the banknotes are fed out. The tape-type storage unit also has an advantage capable of storing the banknotes of various sizes in a mixed state. The temporary storage unit 24 may adopt a known configuration of the tape-type storage unit.

The recognition unit 25 is disposed in a first transport path 411. The recognition unit 25 recognizes at least the authenticity, denomination, and fitness of each banknote transported along the first transport path 411. The recognition unit 25 also acquires the serial number of the banknote.

In the example illustrated in FIG. 1, the banknote processing apparatus 1 comprises five storage devices 31 to 35. In the following description, these five storage devices may be referred to as a first storage device 31, a second storage device 32, a third storage device 33, a fourth storage device 34, and a fifth storage device 35. The first storage device 31, the second storage device 32, the third storage device 33, the fourth storage device 34, and the fifth storage device 35 are disposed in the longitudinal direction.

Each of the first storage device 31, the second storage device 32, and the third storage device 33 comprises single storage unit S. These storage units S are stack-type storage units for storing banknotes in a stacked manner.

The storage units S of the first storage device 31, the second storage device 32, and the third storage device 33 comprise the same first storage mechanism. Inside the storage device, a storage space for storing and holding the banknote is formed. The storage mechanism is a mechanism that configures the storage space. The same storage mechanism means that the structure of the storage mechanism is substantially the same. Therefore, the same storage mechanism means that the shape and volume of the storage space are almost the same. The first storage device 31, the second storage device 32, and the third storage device 33 comprise the storage space of the same shape and volume.

The storage unit S of each of the first storage device 31, the second storage device 32, and the third the storage device 33 also comprises a transport mechanism. The transport mechanism inserts the banknote from the outside of the storage device to the inside to store the banknote in the storage space of the storage unit S. The transport mechanism also feeds the banknote stored in the storage space of the storage unit S from the inside of the storage device to the outside. In the following description, the banknote stored in the storage space of the storage unit S may be simply referred to as the banknote stored in the storage unit S.

Thus, the first storage device 31, the second storage device 32, and the third storage device 33 comprise the same configuration.

Each of the fourth storage device 34 and the fifth storage device 35 comprises two storage units, i.e., a first storage unit S1 and a second storage unit S2. The first storage unit S1 comprises a second storage mechanism, and the second storage unit S2 comprises a third storage mechanism different from the first storage mechanism. The second storage mechanism and the third storage mechanism comprise a structure different from that of the first storage mechanism.

The first storage unit S1 of the fourth storage device 34 and the first storage unit S1 of the fifth storage device 35 comprise a storage space of the same shape and volume. Further, the second storage unit S2 of the fourth storage device 34 and the second storage unit S2 of the fifth storage device 35 comprise a storage space of the same shape and volume.

In the fourth storage device 34 and the fifth storage device 35, the first storage unit S1 and the second storage unit S2 are independent of each other. The second storage unit S2 is provided on the lower side of the first storage unit S1. Each of the fourth storage device 34 and the fifth storage device 35 can store the banknote in the first storage unit S1 and feed out the banknote from the first storage unit S1. Each of the fourth storage device 34 and the fifth storage device 35 also can store the banknote in the second storage unit S2, and feed out the banknote from the second storage unit S2.

Thus, the fourth storage device 34 and the fifth storage device 35 comprise the same configuration.

The configuration of the storage device in FIG. 1 is an example, and the number and arrangement of storage devices accommodated in the safe housing 131 and the structure of each storage device are not limited to the configuration in FIG. 1. For example, at least one of the storage devices 31 to 35 may be a tape-type storage device as with the temporary storage unit 24.

The transport unit 4 comprises a transport path for transporting the banknotes one by one at appropriate intervals between the banknotes in the banknote processing apparatus 1. The transport path is configured by a number of rollers, a plurality of belts, a motor for driving them, a combination of a plurality of guides, and the like. The transport unit 4 transports the banknote with the long side edge of the banknote facing forward, for example. The transport unit 4 may transport the banknote with the short side edge of the banknote facing forward.

The transport unit 4 comprises the upper transport unit 41, the lower transport unit 42, and the second lower transport unit 43. The upper transport unit 41, as described above, is disposed in the upper housing 20. The lower transport unit 42 and the second lower transport unit 43 are disposed in the safe housing 131.

The upper transport unit 41 comprises the first transport path 411, a second transport path 412, a third transport path 413, a fourth transport path 414, a fifth transport path 415, a sixth transport path 416, a seventh transport path 417, and an eighth transport path 418.

At the upper wall forming the safe housing 131, three transport paths are formed so as to penetrate in the vertical direction. These three transport paths are disposed in the longitudinal direction. One of the three transport paths connects the sixth transport path 416 and a ninth transport path 421 to be described later. Another transport path connects the seventh transport path 417 and a tenth transport path 422. Another transport path connects the eighth transport path 418 and an eleventh transport path 420.

The first transport path 411 is formed in a loop shape. More particularly, the first transport path 411 comprises an upper path 4111 extending in the longitudinal direction, and a lower path 4112 parallel to the upper path 4111. The first transport path 411 comprises a front reversing unit 4113 that connects the upper path 4111 and the lower path 4112 on the front side. The first transport path 411 comprises a rear reversing unit 4114 that connects the upper path 4111 and the lower path 4112 on the rear side. The recognition unit 25 is disposed in the upper path 4111. The transport unit 4 transports the banknote in each of the clockwise direction and the counterclockwise direction in FIG. 1, along the first transport path 411.

The second transport path 412 connects the upper path 4111 of the first transport path 411 and the deposit unit 21 with each other. The second transport path 412 transports the banknote from the deposit unit 21 toward the first transport path 411.

The third transport path 413 connects the front reversing unit 4113 of the first transport path 411 and the dispense unit 22 with each other. The third transport path 413 transports the banknote from the front reversing unit 4113 toward the dispense unit 22. A diverter for changing the transport destination of the banknote is provided at a connection point between the third transport path 413 and the front reversing unit 4113.

The fourth transport path 414 connects the rejection unit 23 and the midway point of the third transport path 413 with each other. The fourth transport path 414 transports the banknote from the third transport path 413 toward the rejection unit 23. A diverter is provided at a connection point between the fourth transport path 414 and the third transport path 413.

The fifth transport path 415 connects the temporary storage unit 24 and the front reversing unit 4113 of the first transport path 411 with each other. The fifth transport path 415 transports the banknote from the front reversing unit 4113 to the temporary storage unit 24, and transports the banknote from the temporary storage unit 24 to the front reversing unit 4113. A diverter is provided at a connection point between the fifth transport path 415 and the front reversing unit 4113.

The sixth transport path 416 connects the lower transport unit 42 and the front reversing unit 4113 of the first transport path 411 with each other. The sixth transport path 416 transports the banknote from the front reversing unit 4113 toward the lower transport unit 42, and transports the banknote from the lower transport unit 42 toward the front reversing unit 4113. A diverter is provided at a connection point between the sixth transport path 416 and the front reversing unit 4113.

The seventh transport path 417 connects the lower transport unit 42 and the lower path 4112 of the first transport path 411 with each other. The seventh transport path 417 transports the banknote from the lower path 4112 toward the lower transport unit 42, and transports the banknote from the lower transport unit 42 toward the lower path 4112. A diverter is provided at a connection point between the seventh transport path 417 and the lower path 4112.

The lower transport unit 42 is disposed on the upper side of the storage devices 31 to 35. The lower transport unit 42 extends in the longitudinal direction. The lower transport unit 42 comprises the ninth transport path 421, the tenth transport path 422, and the eleventh transport path 420. The lower transport unit 42 is unitized by comprising the ninth transport path 421, the tenth transport path 422, and the eleventh transport path 420.

The ninth transport path 421 connects the second lower transport unit 43 and the sixth transport path 416 with each other. The ninth transport path 421 transports the banknote from the sixth transport path 416 toward the second lower transport unit 43, and transports the banknote from the second lower transport unit 43 toward the sixth transport path 416.

The tenth transport path 422 connects each of storage units S of the first storage device 31, the second storage device 32, and the third storage device 33, and the seventh transport path 417 with each other. The tenth transport path 422 transports the banknote from the seventh transport path 417 to each of the storage devices 31 to 33, and transports the banknote from each of the storage devices 31 to 33 to the seventh transport path 417. More specifically, the tenth transport path 422 extends in the longitudinal direction. An edge of the tenth transport path 422 is connected to the first storage device 31. The tenth transport path 422 comprises a first divergence path 423, a second divergence path 424, and a third divergence path 425. The first divergence path 423 is connected to the second storage device 32. The second divergence path 424 is connected to the third storage device 33. The third divergence path 425 is connected to the first storage unit S1 of the fourth storage device 34. A diverter is disposed at a divergence point between the divergence paths 423, 424, and 425.

The eleventh transport path 420 connects the first storage unit S1 of the fifth storage device 35 and the eighth transport path 418 with each other. The eleventh transport path 420 transports the banknote from the eighth transport path 418 to the fifth storage device 35, and transports the banknote from the fifth storage device 35 to the eighth transport path 418.

The second lower transport unit 43 is disposed between the fourth storage device 34 and the fifth storage device 35. The second lower transport unit 43 extends in the vertical direction. The second lower transport unit 43 comprises a twelfth transport path 431. The twelfth transport path 431 extends in the vertical direction. The twelfth transport path 431 comprises a fourth divergence path 433 and a sixth divergence path 435. The fourth divergence path 433 is connected to the second storage unit S2 of the fifth storage device 35. The sixth divergence path 435 is connected to the second storage unit S2 of the fourth storage device 34. A diverter is disposed at a divergence point between the fourth divergence path 433 and the sixth divergence path 435.

Passage sensors for detecting passage of banknotes are disposed in each points of the transport unit 4. The transport unit 4 transports the banknote to the predetermined transport destination by controlling each diverter based on the detection signal of the passage sensors, when receiving a command from a controller 15 to be described later. Further, the controller 15 counts the number of banknotes stored in each storage unit based on the detection signal of the passage sensors. A structural configuration of controller 15 is described below with respect to FIG. 9.

As illustrated in FIG. 2, the banknote processing apparatus 1 comprises the controller 15. The deposit unit 21, the dispense unit 22, the rejection unit 23, the temporary storage unit 24, the recognition unit 25, the transport unit 4, the first storage device 31, the second storage device 32, the third storage device 33, the fourth storage device 34, and the fifth storage device 35 are connected to the controller 15 capable of transmitting and receiving signals, respectively.

The banknote processing apparatus 1 comprises an operation unit 26 operated by the operator, a memory unit 27 for memorizing various data and the like, a communication unit 28 for communicating with a terminal 29, and a display 210 for displaying various information. The operation unit 26, the memory unit 27, the communication unit 28, and the display 210 are also connected to the controller 15 capable of transmitting and receiving signals. The operation unit 26 may be configured by, for example, a touch screen type display device. The terminal 29 is operated by the operator to execute various processing by using the banknote processing apparatus 1.

The controller 15 controls the deposit unit 21, the dispense unit 22, the rejection unit 23, the temporary storage unit 24, the recognition unit 25, the transport unit 4, the first storage device 31, the second storage device 32, the third storage device 33, the fourth storage device 34, and the fifth storage device 35 so that various processing is executed, when the operator operates the operation unit 26 or when the operator operates the terminal 29.

The controller 15 is an electrical circuit. More specifically, the controller 15 comprises a microcomputer, i.e., a processor. The controller 15 may be configured by a single computer or may be configured by a plurality of computers. The controller 15 may also be encompassed by or comprise control circuitry and/or processing circuitry. Further discussion of controller 15 is provided below with respect to FIG. 9.

The memory unit 27 is configured by a solid-state memory such as a RAM, ROM, eMMC, or an SSD. The eMMC is an abbreviation for an embedded Multi Media Card. The SSD is an abbreviation for Solid State Drive. Various data and software are stored in the memory unit 27. The controller 15 executes various types of software in the memory unit 27. The memory unit 27 may be configured by a single memory or a plurality of memories. The memory unit 27 may also be encompassed by or comprise non-transitory computer readable storage medium. Further discussion of memory unit 27 is provided below with respect to FIG. 9. Hereinafter, an operation when the banknote processing apparatus 1 executes various processes will be described.

(Deposit Processing)

The banknote processing apparatus 1 receives a banknote at the time of deposit processing, and stores it in the storage unit of each storage device. When the operator inserts the banknote to be deposited into the deposit unit 21, the deposit unit 21 takes the banknotes one by one into the apparatus. The transport unit 4 transports the banknote to the recognition unit 25. The recognition unit 25 recognizes the banknote and sorts it into a plurality of categories. The transport unit 4 transports the banknote to the first storage device 31, the second storage device 32, the third storage device 33, the fourth storage device 34, or the fifth storage device 35 for each category sorted as a result of the recognition of the recognition unit 25. Each storage device stores the banknote for each category in the storage unit of each storage device.

The category sorted by the recognition unit 25 is, for example, a category defined based on at least one of the denomination, the fitness, and the storage posture. The denomination means a type according to a difference in face value of the banknote. The fitness means the sorting based on the degree of damage of the banknote, i.e., the quantity of bends and stains. The storage posture means sorting based on the front and back of the banknote, the direction in which the long side of the banknote faces, for example, or the like. As a concrete example, when the category is denomination, a thousand-yen note is stored in the storage unit S of the first storage device 31, a five thousand-yen note is stored in the storage unit S of the second storage device 32, and a ten thousand-yen note is stored in the storage unit S of the third storage device 33.

The transport unit 4 transports the banknote judged to be rejected to the dispense unit 22 based on the recognition result of the recognition unit 25. These operations in the deposit processing are executed by the controller 15 controlling the each unit.

When all of the banknotes inserted into the deposit unit 21 are taken into the banknote processing apparatus 1, for example, the terminal 29 displays the deposit amount. When the deposit processing is decided by the operator operating the terminal 29 or operating the operation unit 26, the deposit processing is terminated. The controller 15 memorizes data relating to a deposit transaction such as the denomination and the number of deposited banknotes in the memory unit 27. The controller 15 updates data relating to the inventory amount of the banknote stored in the storage devices 31 to 35, and memorizes the updated data in the memory unit 27. The controller 15 adds data relating to the serial number of the banknote stored in the storage devices 31 to 35 to the serial number list of the memory unit 27.

At the time of the deposit processing, when the number of banknotes stored in each storage unit reaches a predetermined set value, the controller 15 stops depositing more banknotes. The set value is the upper limit number of banknotes stored in each storage unit. For example, the controller 15 counts the number of banknotes stored in each storage unit based on the output signal of the passage sensor provided near the inlet of each storage unit. When the number of banknotes stored in the storage unit reaches the set value, the controller 15 stops taking in further banknotes by the deposit unit 21, and also stops transporting of the banknotes being transported. The controller 15 may cause the transport unit 4 to transport the banknote during transporting to the rejection unit 23 and cause the rejection unit 23 to reject the banknote.

At a point in time when the number of banknotes stored in the storage unit reaches the set value, the controller 15 causes the display 210 or the like to notify that the storage unit is full to the operator. As a result, the operator can perform an appropriate operation for resolving the full state of the storage unit. Concretely, the operator performs an operation of replacing the storage device containing the storage unit which is full.

In the banknote processing apparatus 1 according to the embodiment of the present disclosure, the set value decision processing for previously deciding the set value relating to the upper limit number of banknotes stored in each storage unit is executed at any time. Details of the set value decision processing will be described later.

In addition, the controller 15 stops depositing of more banknotes, even when it is determined that the storage unit is full based on the storage state of the storage unit. The storage state of the storage unit is, for example, a state of the banknote stored in the storage unit. The storage state of the storage unit may be a state based on the position of the configuration member of the storage unit. Concretely, the storage state of the storage unit may be detected by a detection sensor 71 (see FIG. 4, etc.) described later.

Further, at the time of the deposit processing of the banknote processing apparatus 1, the deposited banknote can be temporarily stored by using the temporary storage unit 24. In this case, the transport unit 4 transports the banknote passed through the recognition unit 25 to the temporary storage unit 24. The temporary storage unit 24 stores the banknote. After all of the banknotes inserted into the deposit unit 21 are taken into the banknote processing apparatus 1, for example, the terminal 29 displays the deposit amount. The operator can select the confirmation of the deposit processing and the cancellation of the deposit processing by operating the terminal 29 or by operating the operation unit 26. When the operator confirms the deposit processing, the transport unit 4 transports the banknote fed out by the temporary storage unit 24 to the first storage device 31, the second storage device 32, the third storage device 33, the fourth storage device 34, or the fifth storage device 35. The storage devices 31 to 35 store the banknote. When the operator cancels the deposit processing, the transport unit 4 transports the banknote fed out by the temporary storage unit 24 to the dispense unit 22. Thus, the banknote to be deposited is returned.

(Withdrawal Processing)

The banknote processing apparatus 1 discharges the banknote to the outside of the banknote processing apparatus 1 at the time of the withdrawal processing. The storage devices 31 to 35 feed out the banknote to be dispensed. The transport unit 4 transports the banknote to the recognition unit 25. The recognition unit 25 recognizes the banknote. The transport unit 4 transports the recognized banknote to the dispense unit 22. The dispense unit 22 holds the banknote to be dispensed. The transport unit 4 transports the banknote recognized by the recognition unit 25 as the banknote to be rejected to the rejection unit 23. The rejection unit 23 stores the banknote to be rejected. When all of the banknotes to be withdrawn are dispensed to the dispense unit 22, the withdrawal processing is terminated. The controller 15 causes the memory unit 27 to memorize data relating to the withdrawal transaction such as the denomination and the number of withdrawn banknotes. In addition, the controller 15 updates data relating to the inventory amount of the banknote stored in the storage devices 31 to 35, and memorizes the updated data in the memory unit 27. In addition, the controller 15 deletes the data relating to the banknote fed out from the storage devices 31 to 35, from the serial number list of the memory unit 27.

(Configuration of Storage Device)

Hereinafter, the configurations of the storage devices 31 to 35 will be described.

As described above, the first storage device 31, the second storage device 32, and the third storage device 33 each comprise one storage unit S, and the fourth storage device 34 and the fifth storage device 35 each comprise two storage units (the first storage unit S1 and the second storage unit S2). The storage units S of the first storage device 31, the second storage device 32, and the third storage device 33 comprise the same first housing mechanism, respectively. In addition, the first storage units S1 of the fourth storage device 34 and the fifth storage device 35 comprise the same second storage mechanism, and the second storage units S2 of the fourth storage device 34 and the fifth storage device 35 comprise the same third storage mechanism, respectively. The first, second and third storage mechanisms are different from each other.

Hereinafter, a configuration of the fourth storage device 34 or the fifth storage device 35 comprising two storage units will be described. Since the fourth storage device 34 and the fifth storage device 35 comprise the same configuration, they are not distinguished from each other in the following description, and they are simply described as the storage device 5.

Figure 3:
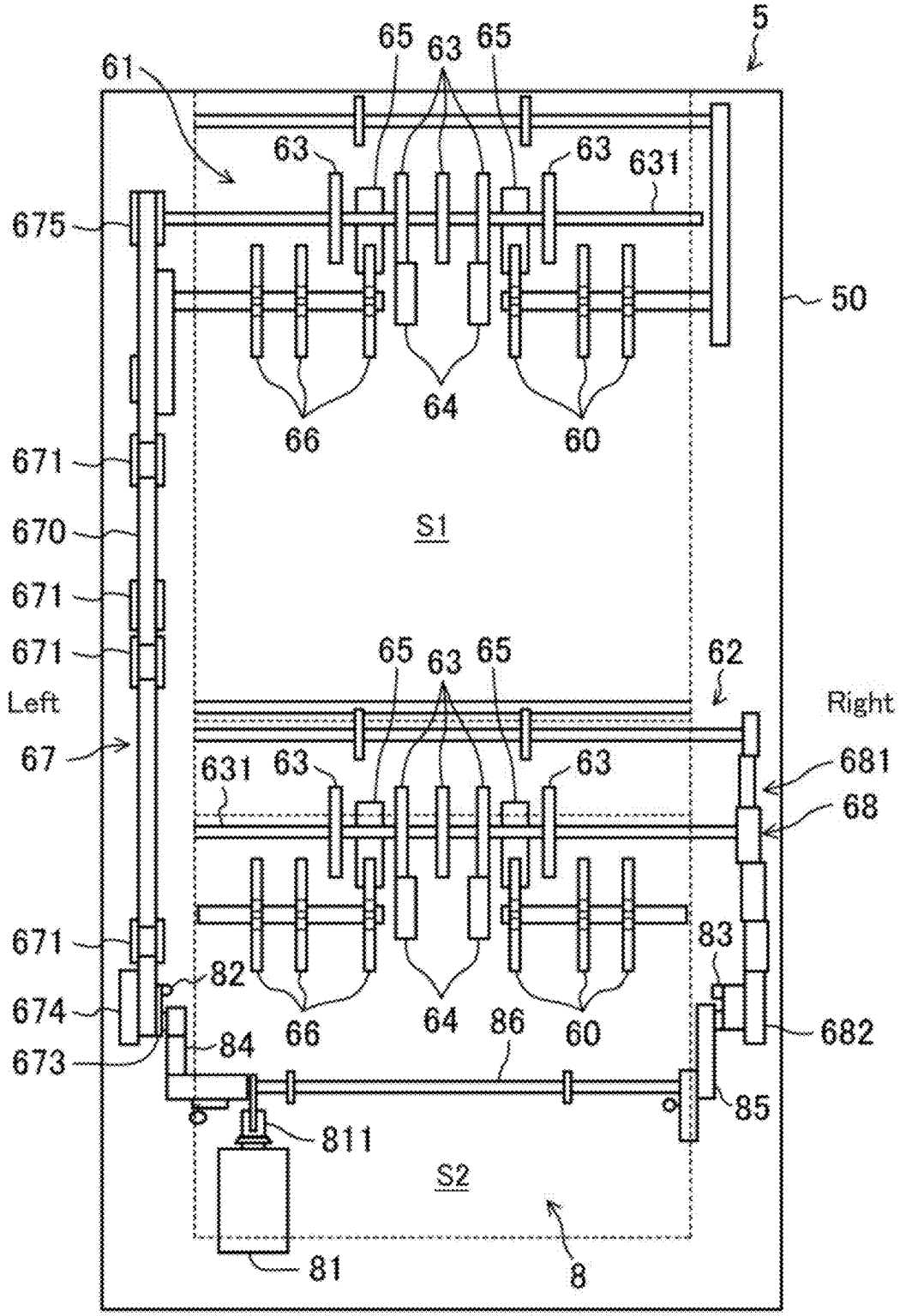
FIG. 3 is a front view of an internal structure of a storage device.
Figure 4:
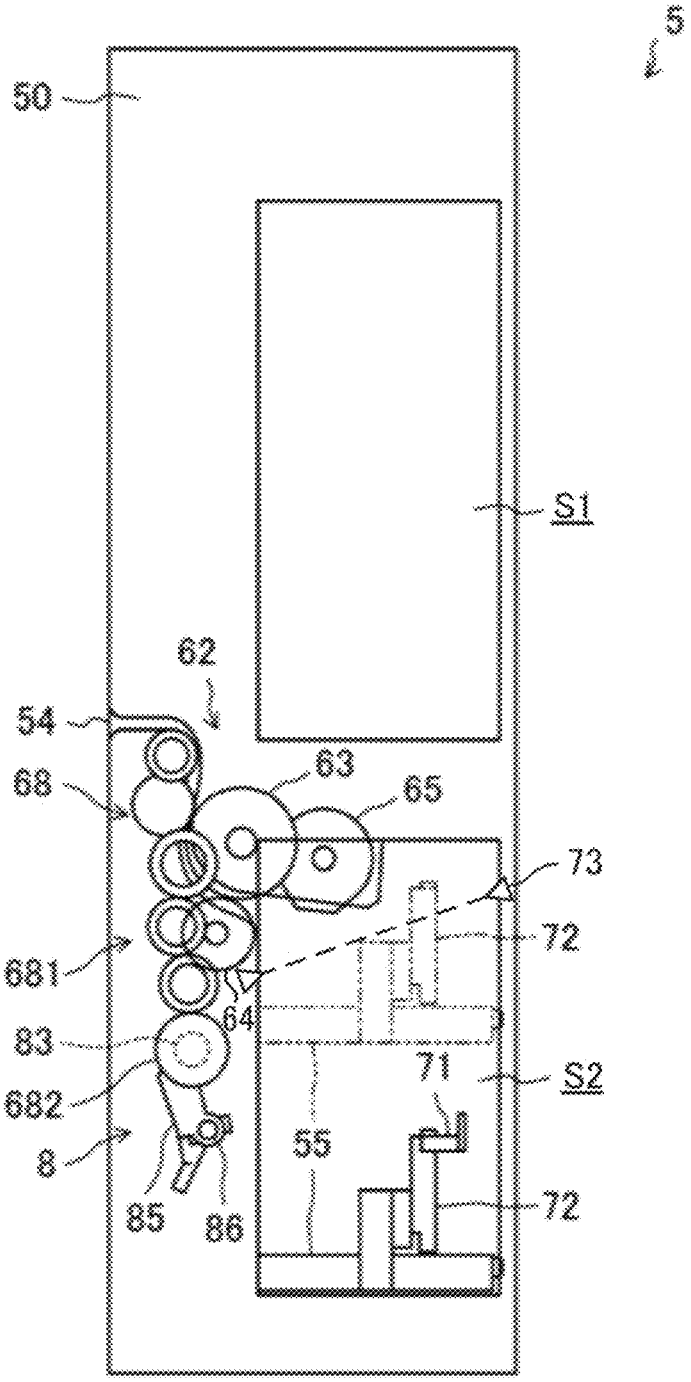
FIG. 4 is a view of a structure of a second storage unit of a lower side when seen from a right side of the storage device.

FIG. 3 is a front view of the internal structure of the storage device 5. FIG. 4 is a view of the structure of the second storage unit S2 on the lower side when seen from the right side of the storage device 5. For simplicity, in FIG. 4, the illustration of the first storage unit S1 on the upper side is omitted.

The storage device 5 comprises the first storage unit S1 and the second storage unit S2. Each of the first storage unit S1 and the second storage unit S2 comprises a stage 55. The stage 55 is a stage for stacking and holding the banknote. The stage 55 moves up and down in the storage space of the first storage unit S1 or the second storage unit S2 in accordance with the amount of stacked banknotes. As a concrete example, when the banknote of a predetermined amount, for example, twenty are stacked on the stage 55, the stage 55 moves downward in the storage space. At this time, the controller 15 detects the presence or absence of the banknote accumulated in the stage 55 by using the detection sensor 71 provided in the upper part of the storage space. At the time that the banknote accumulated on the stage 55 becomes undetectable by the detection sensor 71, the controller 15 stops the movement of the stage 55. Thus, the uppermost position of the banknotes stacked on the stage 55 becomes an almost constant position regardless of the amount of the banknotes.

A first transport mechanism 61 for the first storage unit S1 comprises a feed roller 63, a gate roller 64, a kicker roller 65, a stacking wheel 66, and a first transmission unit 67. A second transport mechanism 62 for the second storage unit S2 comprises the feed roller 63, the gate roller 64, the kicker roller 65, the stacking wheel 66, and a second transmission unit 68.

A passage port through which the banknote passes is provided on the upper part of the storage device 5. A part of the eleventh transport path 420 is inserted into the passage port. The feed roller 63 inserts the banknote from the eleventh transport path 420 into the first storage unit S1. The feed roller 63 also discharges the banknote in the first storage unit S1 through the eleventh transport path 420. The feed roller 63 is supported by a support shaft 631 extending in the lateral direction perpendicular to the longitudinal direction. The support shaft 631 supports five feed rollers 63. Each feed roller 63 is rotatable in both clockwise and counterclockwise directions around a support shaft 631.

A passage port 54 through which the banknote passes is provided on the side surface of the storage device 5. A part of the fourth divergence path 433 is inserted into the passage port 54. The feed roller 63 inserts the banknote from the fourth divergence path 433 into the second storage unit S2. The feed roller 63 also discharges the banknote in the second storage unit S2 through the fourth divergence path 433. The feed roller 63 is supported by the support shaft 631 extending in the lateral direction perpendicular to the longitudinal direction. The support shaft 631 supports five feed rollers 63. Each feed roller 63 is rotatable in both clockwise and counterclockwise directions around the support shaft 631.

The first transport mechanism 61 and the second transport mechanism 62 comprises two gate rollers 64, respectively. Each gate roller is opposite to the feed roller 63 and is in pressure contact with the feed roller 63. In the gate roller 64, a one-way clutch is provided. The one-way clutch allows the gate roller 64 to rotate in the inserting direction of the banknote (the clockwise direction in FIG. 4) and prohibits to rotate in the discharging direction (the counterclockwise direction in FIG. 4). When the banknote is inserted into the first storage unit S1 or the second storage unit S2, the gate roller 64 rotates along with the feed roller 63 to rotate in the direction that the banknote is inserted. When the banknote is discharged from the first storage unit S1 or the second storage unit S2, the gate roller 64 does not rotate by the one-way clutch. When the banknotes are discharged from the first storage unit S1 or the second storage unit S2, the banknotes separated one by one between the feed roller 63 and the gate roller 64.

In the kicker roller 65, a friction part is formed on a part of the outer peripheral surface thereof. The kicker roller 65 feeds out the uppermost banknote one by one when feeding out the banknotes stacked on the stage 55. When the kicker roller 65 rotates in the clockwise direction in FIG. 4, the friction unit hits the surface of the uppermost banknote, and the banknote moves in the discharge direction. The uppermost banknote is kicked out between the feed roller 63 and the gate roller 64.

The stacking wheel 66 comprises a plurality of vanes. The plurality of vanes is provided radially at equal intervals in the circumferential direction. The stacking wheel 66 rotates when the banknotes are stacked on the stage 55. The vane strikes the rear edge part of the banknote and drops the banknote down.

The storage device 5 does not comprise a drive unit for driving the first transport mechanism 61 and the second transport mechanism 62. The first transmission unit 67 of the first transport mechanism 61, and the second transmission unit 68 of the second transport mechanism 62, respectively, transmit the driving force of the driving unit of the banknote processing apparatus 1 to the feed roller 63, in a state where the storage device 5 is attached to the banknote processing apparatus 1, The first transmission unit 67 is disposed on the left side part of the storage device 5. The first transmission unit 67 transmits the driving force to the first transport mechanism 61 for the first storage unit S1. The first transmission unit 67 extends in the vertical direction. The first transmission unit 67 comprises a transmission belt 670 and a plurality of pulleys 671 around which the transmission belt 670 is wound. The transmission belt 670 is a toothed belt in this configuration example. The plurality of pulleys 671 is disposed at a predetermined position in the vertical direction, on the left side unit of the storage device 5. The transmission belt 670 is wound around the first pulley 673. The first pulley 673 is disposed in the lower part of the storage device 5. The first pulley 673 is integrated with a first connection unit 674. The first connection unit 674 is connected to the first driving unit of the banknote processing apparatus 1 in a state which the storage device 5 is attached to the banknote processing apparatus 1. The first connection unit 674 rotates by the first driving unit, the first pulley 673 rotates with the first connection unit 674. The transmission belt 670 is also wound around a second pulley 675. The second pulley 675 is disposed on the upper part of the storage device 5. The second pulley 675 is fixed to the support shaft 631 for supporting the feed roller 63. When the first pulley 673 rotates and the transmission belt 670 travels, the second pulley 675 rotates. When the second pulley 675 rotates, the feed roller 63 rotates through the support shaft 631.

The second transmission unit 68 is disposed on the right side part of the storage device 5. The second transmission unit 68 transmits the driving force to the second transport mechanism 62 for the second storage unit S2. The second transmission unit 68 extends in the vertical direction. The second transmission unit 68 comprises a plurality of gears. The plurality of gears configures a gear array 681 with meshing with each other. One of the plurality of gears configures a second connection unit 682. The second connection unit 682 is connected to the second driving unit of the banknote processing apparatus 1 in a state which the storage device 5 is attached to the banknote processing apparatus 1. The second connection unit 682 is rotated by the second driving unit. One of the plurality of gears is fixed to the support shaft 631 which supports the feed roller 63.

When the second connection unit 682 rotates, the rotational force is transmitted through the gear array 681.

As a result, the feed roller 63 rotates through the support shaft 631.

(Configuration of Detection Sensor)

The storage device 5 comprises a sensor for detecting the storage state of the storage unit. The storage state of the storage unit is, for example, a position of a configuration member of the storage unit. The configuration member of the storage unit is, for example, a stage 55. The banknote processing apparatus can detect that the storage unit is full or near full based on the storage state of the storage unit. That is, the storage device 5 comprises the detection sensor 71 for detecting that the storage unit become full or near full. In the present embodiment, the full state means a state in which the storage unit is full and there is no physical space for storing a new banknote in the storage unit. The near full state means a state in which is close to the full state, and which a physical space for storing a new banknote in the storage unit is small.

The detection sensor 71 is configured with, for example, a transmission-type optical sensor. The detection sensor 71 comprises a light emission unit and a light reception unit. The detection sensor 71 detects a state in which the light reception unit receives the light emitted by the light emission unit, and a state in which the light reception unit does not receive the light by a detection plate 72 shielding the light emitted by the light emission unit. As illustrated in FIG. 4, the detection sensor 71 is attached to the housing 50. The detection plate 72 is fixed to the stage 55. As described above, the stage 55 moves down in accordance with the amount of banknote stored in the storage unit. The stage 55 is in a predetermined position when it is full, and in a position above the predetermined position when it is near full.

Figure 5:
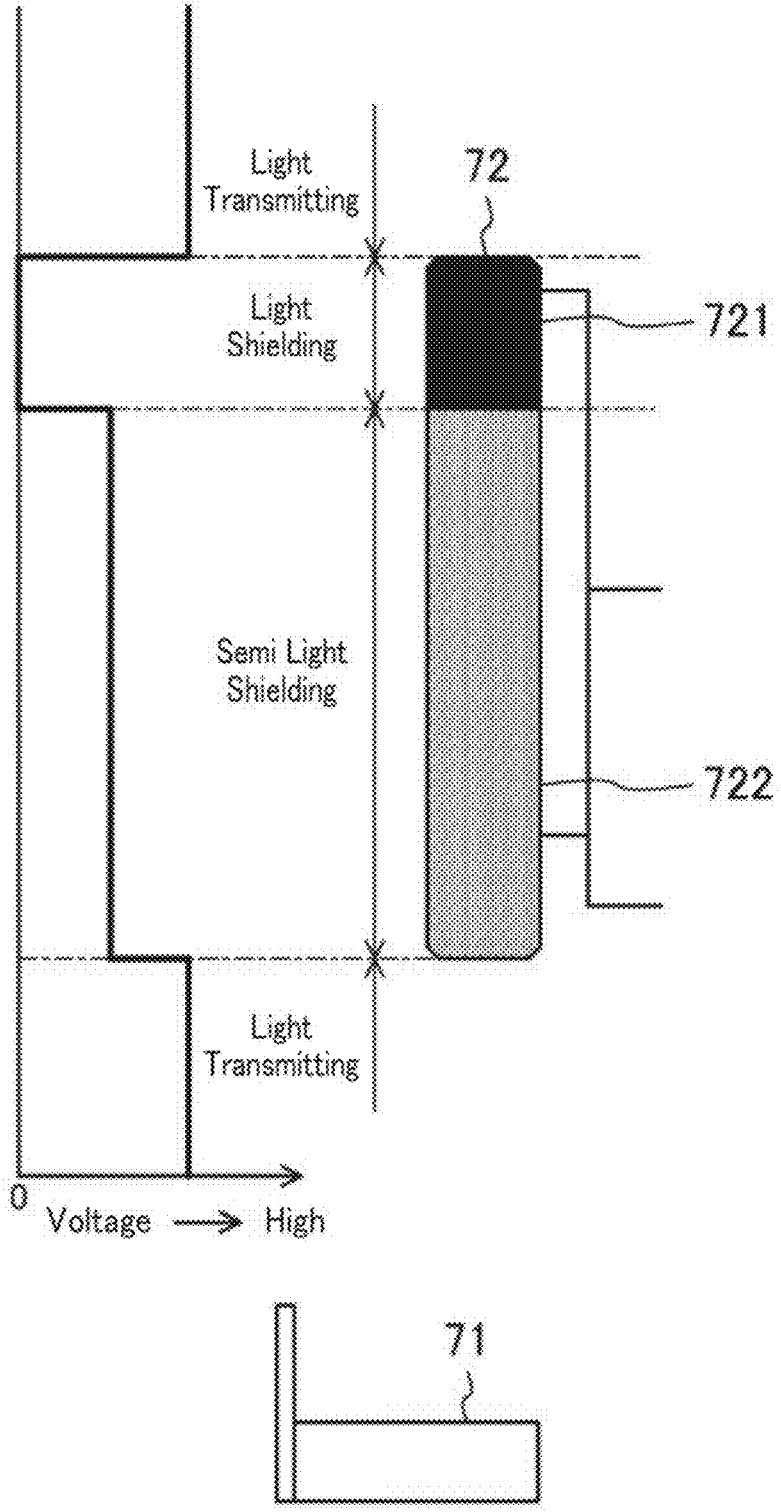
FIG. 5 is a diagram showing an operation principle of a detection plate and a detection sensor.

FIG. 5 is a diagram for explaining an operation principle of the detection plate 72 and the detection sensor 71. The detection plate 72 is long in the vertical direction. The detection plate 72 comprises a light shield unit 721, and a semi light shield unit 722. The light shield unit 721 is a part which light shield ratio is 100% or almost 100% and substantially shields the light. The light shield ratio of the semi light shield unit 722 is lower than 100% and higher than 0%. The light shield ratio of the semi light shield unit 722 transmits the light, but reduces the intensity of the transmitted light.

As illustrated in FIG. 5, the detection sensor 71 outputs a voltage signal corresponding to the intensity of the received light to the controller 15. Since the light shield unit 721 shields the light, when the light shield unit 721 shields the optical axis of the detection sensor 71, the voltage signal of the detection sensor 71 is zero or substantially zero. When the detection plate 72 does not shield the optical axis of the detection sensor 71, the voltage signal of the detection sensor 71 is maximum or substantially maximum.

Since the intensity of light transmitted through the semi light shield unit 722 is reduced, when the semi light shield unit 722 shields the optical axis of the detection sensor 71, the voltage signal of the detection sensor 71 is between zero and the maximum.

The light shield unit 721 is provided at the upper end part of the detection plate 72. The semi light shield unit 722 is provided at a part excluding the upper end part of the detection plate 72. The semi light shield unit 722 is provided under the light shield unit 721. The light shield unit 721 and the semi light shield unit 722 are continuous.

During the stage 55 is positioned at the upper part in the storage unit, the detection plate 72 does not shield the optical axis of the detection sensor 71. Therefore, the voltage signal of the detection sensor 71 is maximized. When the stage 55 moves down, the semi light shield unit 722 of the detection plate 72 shields the optical axis of the detection sensor 71. Therefore, the voltage signal of the detection sensor 71 is lowered than the maximum, but does not reach to zero. Thus, the controller 15 can judge that the storage unit is near full. When the stage 55 moves down further, the light shield unit 721 of the detection plate 72 shields the optical axis of the detection sensor 71. Therefore, the voltage signal of the detection sensor 71 becomes zero. Thus, the controller 15 can judge that the storage unit is full.

When the stage 55 moves up from the state that the storage unit is in the near full state, the detection plate 72 does not shields the optical axis of the detection sensor 71. Therefore, the voltage signal of the detection sensor 71 changes from the intermediate state to the maximum. This change in the voltage signal allows the controller 15 to detect that the stage 55 has moved up. When the stage 55 moves down further from the state that the storage unit is full, the detection plate 72 does not shields the optical axis of the detection sensor 71. Therefore, the voltage signal of the detection sensor 71 changes from zero to the maximum. This change in voltage signal allows the controller 15 to detect that the stage 55 has moved down further. Therefore, by using the detection plate 72, the controller 15 can detect not only the full state and the near full state of the storage unit, but a state in which the position of the stage 55 is higher than the near full state, and a state in which the position of the stage 55 is lower than the full state.

In this way, the detection sensor 71 outputs an electrical signal indicating the full state or near full state of the storage unit, based on whether the detection plate 72 shields the optical axis, regardless of the number of banknotes stored in the storage unit. Therefore, the controller 15 can detect that the storage unit is full or near full by the electrical signal output by the detection sensor 71, regardless of the number of banknotes actually stored in the storage unit.

The controller 15 may executes level adjustment of the detection sensor, by using the semi light shield unit 722 in the detection plate 72 illustrated in FIG. 5. Furthermore, in the detection plate 72, the position of the light shield unit 721 may be replaced with the position of the semi light shield unit 722.

(Set Value Decision Processing)

Hereinafter, a set value decision processing for deciding a set value as the upper limit number of banknotes storable in the storage unit at the time of the deposit processing will be described in detail. The storage unit in the following description is the storage unit S comprised by the first storage device 31, the second storage device 32, and the third storage device 33, or the first storage unit S1 or the second storage unit S2 comprised by the fourth storage device 34 or the fifth storage device 35.

Figure 6:
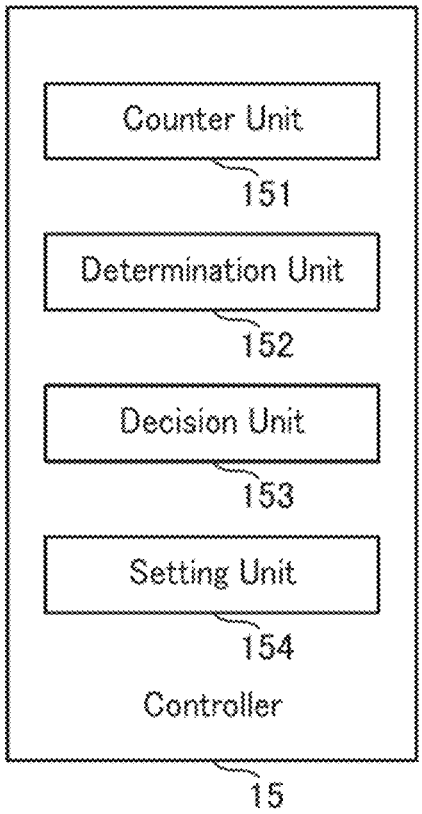
FIG. 6 is a diagram illustrating an exemplary configuration of a controller for executing a set value decision processing.

FIG. 6 is a diagram illustrating an example of the configuration of the controller 15 for executing the set value decision processing. As illustrated in FIG. 6, the controller 15 comprises a counter unit 151, a determination unit 152, a decision unit 153, and a setting unit 154. The controller 15 may be, for example, a processor or electric circuit, i.e., circuitry, control circuitry and processing circuitry. Each of the counter unit 151, the determination unit 152, the decision unit 153, and the setting unit 154 may be configured by separate processors or electric circuits, i.e., circuitries. At least two of the counter unit 151, the determination unit 152, the decision unit 153, and the setting unit 154 may be configured by a single processor.

The counter unit 151 counts the stored banknote number which is the number of the banknotes stored in each storage unit, based on the signal output by the passage sensor provided near each part of the transport unit 4, particularly the inlet of each storage unit. The counter unit 151 outputs the count result information indicating the result of counting, i.e., the stored banknote number, to the decision unit 153.

The determination unit 152 determines whether or not each storage unit becomes in the full state based on the storage state of each storage unit. The storage state is the state of the banknote stored in the storage unit or the position of the configuration member of the storage unit. The state of the banknote stored in the storage unit may be, for example, the height of the banknotes stacked and stored in the storage unit. The configuration member of the storage unit may be, for example, the position of the stage 55. For each storage unit, the sensor for detecting the storage state of the storage unit is provided. The sensor may be, for example, the detection sensor 71 (see FIG. 4, etc.). The determination unit 152 determines whether no not each storage unit becomes in the full state, based on the electrical signal output by the sensor. When the full state is detected, the determination unit 152 outputs the storage unit full information indicating that the storage unit becomes in the full state to the decision unit 153. As described above, the detection sensor 71 (the sensor) detects that the storage unit is full, regardless of the number of banknotes stored in the storage unit.

The decision unit 153 generates information indicating the count result acquired from the counter unit 151 at the point in time when the determination unit 152 detects that the storage unit become in the full state and memorizes the information in the memory unit 27, based on the count result information acquired from the counter unit 151 and the storage unit full information acquired from the determination unit 152. In the following description, the count result by the counter unit 151 at the point in time when the determination unit 152 detects that the storage unit become in the full state is described as the full number, and the information indicating the full number is described as the full number information. Then, the decision unit 153 decides a set value relating to the upper limit number of the banknotes by using a plurality of pieces of the full number information.

The setting unit 154 sets the set value decided by the decision unit 153 as the set value of the specific storage unit. Concretely, the setting unit 154 writes the set value decided by the decision unit 153 into the memory unit 27. Alternatively, the setting unit 154 updates the set value already memorized in the memory unit 27 to the set value newly decided by the decision unit 153. The controller 15 refers to the set value memorized in the memory unit 27, and executes processing containing the deposit processing.

The set value relating to the upper limit number of banknotes is a value that the controller 15 regards that the storage unit becomes in a full state at the point in time when the number of banknotes stored in the storage unit reaches the set value. As described above, at the point in time when the number of banknotes stored in each storage unit reaches the set value, the controller 15 stops depositing more banknotes.

In the following description, the set value is a value in which the controller 15 regards that the storage unit becomes in the full state. However, for example, the set value may be a value in which the controller 15 regards that the storage unit becomes in the near-full state. In this case, the determination unit 152 outputs the signal indicating that the storage unit becomes in the near full state to the decision unit 153, when detecting that the storage unit becomes in the near full state based on the electrical signal output by the detection sensor 71.

As a concrete method of determining the set value by the decision unit 153, any of various methods described below can be appropriately adopted.

<First Decision Method>

In the first decision method, the decision unit 153 calculates a set value by calculating an average value of a plurality of full numbers counted at the different times from each other in one storage unit. The plurality of full numbers counted at the different times from each other are the full numbers in full states when the full state occurs a plurality of times at different points in time.

Concrete examples will be described. It is assumed that the full state is detected m times is detected during a period up to a certain point in time in a certain storage unit, and the full numbers in the full states are referred to as N1, . . . , Nm, respectively. In this case, the decision unit 153 decides the set value Ns of that storage unit to the average value of the full numbers for m time. That is, in the first decision method, the set value Ns is calculated by the following equation 1. Provided that m is an integer greater than or equal to 2.

$$Ns=(N1+\ldots+Nm)/m \quad \text{(Equation 1)}$$

According to the first decision method of the set value, the following effects can be obtained.

As a method of deciding a set value different from the first decision method described above, for example, there is a method of deciding the set value to the past full number itself. In such a decision method, when, for example, a large amount of the banknotes having many wrinkles or bends are temporarily stored and the storage unit becomes in the full state, the set value is decided to be a value that is much smaller than the full number of the case where, for example, a new series note is stored. When the full state is erroneously detected due to an abnormality in the storage unit or the determination unit 152, the set value is also decided to be an abnormal value.

However, in the first decision method of the set value in the banknote processing apparatus 1 according to the embodiment of the present disclosure, the set value is the average value of the full numbers in the full state of a plurality of times of one storage unit. Therefore, such a situation can be avoided, and the set value can be decided to a more appropriate value.

In the first decision method, until the information of the full numbers of a plurality of times for calculating the average value is obtained, an initial value appropriately set may be used as the set value. This initial value may be discarded when the set value is decided.

Further, in the above description, as a first decision method, a method of deciding the set value by calculating the average value of the full numbers in all full state that have occurred in one storage unit until a certain time has been described. However, in the first decision method, it is not necessary to calculate the average value by using the full numbers in all full state until a certain point in time. For example, when there is full state of a plurality of times until a certain point in time, the set value may be decided by calculating the average value of the full numbers of specific x times (x is an integer less than or equal to 2). In addition, the set value may be decided by accumulating the full number information relating to the full state of a plurality of times and calculating the average value of the plurality of full numbers in a specific period (e.g., from the present to one week ago, one month ago, or one year ago, or for a past specific year) instead of the number of full state of a plurality of times. Further, the decision unit 153 may decide the set value by calculating an average value of the full numbers in the full state at a specific time (e.g., a specific season, a specific day of the week, or the like).

Further, the decision unit 153 may decide a new set value by calculating an average value until the previous full state, in other words, the average value of the previous set value decided in the previous full state and the full number in the current newly generated full state.

The decision unit 153 decides a different set value for each storage unit by using the above described first decision method in each of all storage units comprised by the banknote processing apparatus 1. The set value decided by the decision unit 153 for each storage unit is set for each storage unit by the decision unit 153. Alternatively, the set value decided by the decision unit 153 in one specific storage unit may be set for another storage unit comprising the same storage mechanism by the setting unit 154.

The decision unit 153 decides the set value of each storage unit at any time, and the setting unit 154 updates the set value stored in the memory unit 27 by using the set value decided by the decision unit 153 at any time. An example of the timing at which the decision unit 153 decides the set value is a timing at which the storage unit full information is newly acquired from the determination unit 152, for example. Alternatively, the decision unit 153 may decide the set value for each predetermined cycle, for example, each several hours, each day, each week, or the like.

The setting unit 154 may not immediately update the set value stored in the memory unit 27 by using the set value newly decided by the decision unit 153. That is, the setting unit 154 may temporarily hold the set value newly decided by the decision unit 153, and update the set value held by the memory unit 27 originally by using the new set value at a predetermined timing. A concrete example of the predetermined timing, for example, is a timing at which the set newly decided by the decision unit 153 is displayed on the display 210 and the like, and the operation of permitting the use of the set value is performed by the operator using the operation unit 26. A concrete example of the predetermined timing contains, for example, a period of time in which the banknote processing apparatus 1 is used less frequently, such as at night, or an arbitrary period of time appropriately set by the operator.

<Second Decision Method>

In the first decision method described above, the decision unit 153 decides the set value by using the average value of the full numbers in the full state that occurred at different points in time in one storage unit. In the second decision method, the decision unit 153 decides the set value by using the average value of the full numbers in the full state that occurred in a plurality of storage units comprising the same storage mechanism and different from each other.

A concrete examples will be described. In the banknote processing apparatus 1, each of the first storage device 31, the second storage device 32, and the third storage device 33 comprises a storage unit S containing the same storage mechanism. For example, it is assumed that the full number in the full state detected in the past in the storage unit S of the first storage device 31 is N1, the full number in the full state detected in the past in the storage unit S of the second storage device 32 is N2, and the full number in the full state detected in the past in the storage unit S of the third storage device 33 is N3. In this case, the decision unit 153 decides the set value Ns by using the following equation 2.

$$Ns=(N1+N2+N3)/3 \quad \text{(Equation 2)}$$

The set value decided by the second decision method is applied to at least one of the storage units S comprised by the first storage device 31, the second storage device 32, and the third storage device 33. The first decision method and the second decision method may be used in combination, for example, the set value decided by the second decision method may be applied to the storage unit S of the first storage device 31, and the set value decided by the first decision method may be applied to the storage unit S of each of the second storage device 32 and the third storage device 33.

In the concrete examples of the second decision method described above, for simplicity, the case has been described in which the average value of the full numbers in the full state for one time of the storage unit S comprised by each of the first storage device 31, the second storage device 32, and the third storage device 33 is calculated. However, in the second decision method, the set value may be decided by calculating the average value of the full numbers in the full state of a plurality of times occurred in the plurality of storage units.

A concrete example will be described. It is assumed that the full state for m times is detected by a certain time in a certain storage unit a, and the full number in each full state is Na1, Na2, . . . , Nam. It is assumed that the full state for n times is detected by a certain time in the storage unit b comprising the same storage mechanism as the storage unit a, and the full number in each full state is Nb1, Nb2, . . . , Nbn.

In this case, the decision unit 153 decides the set value Ns by using the following equation 3.

$$Ns=(Na1+\ldots+Nam+Nb1+\ldots+Nbn)/(m+n) \quad \text{(Equation 3)}$$

The set value decided in this manner may be applied to at least one of the storage units a and b. The set value may be decided by using the average value of the full numbers in the past of a plurality of times in a larger number of storage units instead of two storage.

Further, in the second decision method, the set value may be decided by using the average value of the full numbers in the full state occurred in the storage unit whose use satisfies the predetermined first condition among the plurality of storage units S containing the same storage mechanism. Examples of the use of the storage unit are a recycle use, a collection use, and a temporary holding use, for example. The storage unit for the recycle use is a storage unit in which a large number of banknotes are repeatedly inserted and discharged. The storage unit for collection use is a storage unit that does not feed out the banknote stored once, but only collects the banknotes. The storage unit for the temporary holding use is a storage unit which stores the banknote temporarily and can feed out it as necessary. The predetermined first condition may be that the uses are the same. Also, the predetermined first condition may be that the uses are similar. For example, the recycle use and the temporary holding use may be similar uses.

Further, in the second decision method, the set value may be decided by using the average value of the full numbers in the full state occurred in the plurality of storage units storing the same category of the banknote among the plurality of storage units S containing the same storage mechanism.

A concrete example will be described. For example, in the banknote processing apparatus 1, it is assumed that the same denomination (e.g., ten thousand yen note) is stored in the first storage device 31 and the second storage device 32. Further, it is assumed that the full numbers in the full state detected in the past in the storage unit S of the first storage device 31 is N1, and the full numbers in the full state detected in the past in the storage unit S of the second storage device 32 is N2. In this case, the decision unit 153 decides the set value Ns to the average value (N1+N2)/2.

In the present disclosure, the category contains not only the denomination but also the degree of fitness, the storage posture, and the like. In the second decision method, the decision unit 153 may decide the set value by using the average value of the full numbers in the full state occurred in a plurality of storage units in which the fitness and the storage posture of the stored banknotes are the same. The degree of fitness is a value of sorting the banknote according to the degree of damage of the banknote. The degree of fitness contains, for example, a first degree in which the damage is so small that the banknote can be dispensed from the banknote processing apparatus 1, a second degree in which the banknote cannot be discharged from the banknote processing apparatus 1 but can be dispensed manually by a person, and a third degree in which the degree of damage is so large that the banknote is unsuitable for dispense. The storage posture contains, for example, the front and back of the banknote, or the direction of the stored banknote, i.e., the vertical direction, horizontal direction, or the like.

<Third Decision Method>

Figure 7:
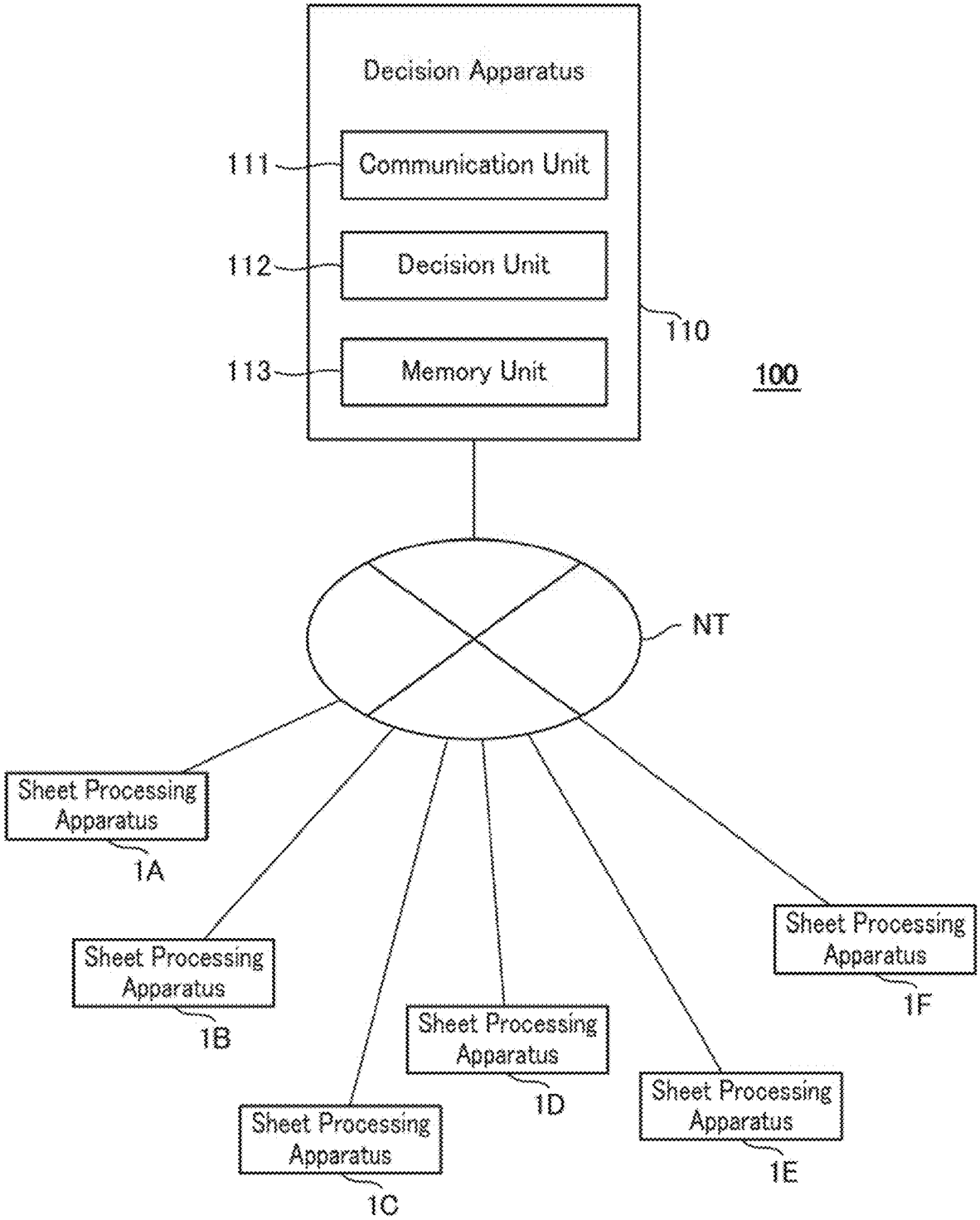
FIG. 7 is a diagram exemplifying a banknote processing system in which a plurality of banknote processing apparatuses is communicably connected to each other.

The third decision method is a method of deciding a set value in the banknote processing system 100 to which a plurality of banknote processing apparatuses 1 are communicably connected. FIG. 7 is a diagram exemplifying a banknote processing system 100 in which a plurality of banknote processing apparatuses is communicably connected to each other. The banknote processing system 100 illustrated in FIG. 7 is an example of the banknote processing system of the present disclosure. In FIG. 7, six banknote processing apparatuses 1A to IF are connected to the network NT. However, the number of banknote processing apparatuses 1 connected to the network NT may be larger or smaller. The banknote processing apparatuses 1A to IF illustrated in FIG. 7 comprises the same configuration as the banknote processing apparatus 1 described by referring to FIGS. 1 to 6. In particular, the banknote processing apparatus 1 comprises the counter unit 151 and the determination unit 152, and generates the count result information, the storage unit full information, and category information relating to the categories of the banknote stored in each of storage units. The category information may be memorized in advance in the memory unit 27 of each banknote processing apparatus 1, or, when each storage units of each banknote processing apparatus comprises a memory unit, may be memorized in these memory units. The banknote processing apparatus 1 comprises the setting unit 154, and sets the set value received from a decision apparatus 110, which will be described later, to the banknote processing apparatus 1.

As illustrated in FIG. 7, a plurality of banknote processing apparatuses 1 are connected to the decision apparatus 110 via a network NT. The decision apparatus 110 comprises a communication unit 111, a decision unit 112, and a memory unit 113.

The communication unit 111 acquires the count result information, the storage unit full information, and the category information relating to the storage unit of each of the banknote processing apparatuses 1, from each banknote processing apparatus 1. The information acquired from each banknote processing apparatus 1 is memorized in the memory unit 113 in association with each other.

The decision unit 112 decides the set value by calculating the average value of the full numbers in the full state occurred until a certain point in time, in a plurality of storage units comprising the same storage mechanism and different from each other among the plurality of storage units of the plurality of banknote processing apparatuses 1, based on the information stored in the memory unit 113, Alternatively, the decision unit 112 decisions the set value by calculating the average value of the full number of banknotes in the full state that has occurred up to a certain point in time in a plurality of storage units having the same storage mechanism and the same category among the plurality of storage units of the plurality of banknote processing apparatuses 1, and in a plurality of storage units that are different from each other, based on the information memorized in the memory unit 113.

The set value decided in this manner is transmitted by the communication unit 111 via the network NT to the banknote processing apparatus 1 comprising the storage unit providing the count result information, the storage unit full information, and the category information used for deciding the set value. The setting unit 154 of each banknote processing apparatus 1 sets the received set value to the corresponding storage unit at a predetermined timing, when the storage unit corresponding to the received set value is comprised. The setting unit 154 of each banknote processing apparatus 1 may or may not set the transmitted set value to the storage unit providing the count result information, the storage unit full information, and the category information used to decide the set value. When not set, the set value for each storage unit may be appropriately decided by using the first or second decision method described above.

In the third decision method, the set value may be decided by calculating the average value of the full numbers in the full state occurred until a certain point in time, in the storage unit comprising the same storage mechanism and satisfying the predetermined second condition. An example of the storage unit satisfying the predetermined second condition is a storage unit comprising a plurality of banknote processing apparatuses 1 installed in the same country or region. Alternatively, another example of the storage unit satisfying the predetermined second condition is a storage unit comprising a plurality of banknote processing apparatuses 1 installed in the same type of facility. The type of facility is, for example, a store such as finance or retail, or a public institution such as a hospital or a public office. Further, another example of the storage unit satisfying the predetermined second condition is a storage unit comprising a plurality of banknote processing apparatuses 1 installed in a facility of the same scale, not the same type. The scale of the facility may be sorted according to, for example, the number of visitors to the facility.

Further, in the third decision method, the set value may be decided by calculating the average value of the full numbers in the full state occurred until a certain point in time, in the storage unit which is comprised by the plurality of banknote processing apparatuses 1 of the same type, and comprises the same type storage mechanism. Examples of the type of the banknote processing device 1 is an ATM (Automatic Teller Machine), a money changer, a self-machine, a TCR (Teller Cash Recycler), a kiosk terminal, a change machine, a deposit machine, and the like. The self-machine is a machine which is operated by an ordinary user to perform the processing by himself/herself.

In the third decision method, the decision unit 112 may decide the set values for all the storage units comprised by the plurality of banknote processing apparatuses 1 connected to the decision apparatus 110, or may decide the set values for only a part of the storage units. Further, the decision unit 112 may decide the set value decided by calculating the average value of the full numbers in the full state occurred in a part of the storage units, transmit it to the banknote processing apparatus 1 comprising another storage unit to apply it. In this case, it is preferable that another storage unit is a storage unit that satisfy the same conditions as the condition of a part of storage units in which the average value of the full numbers is calculated (the storage unit comprises the same storage mechanism, or comprises the same storage mechanism and the category of the banknote to be stored is the same).

The first to third examples of the method of deciding the set value have been described above. In the first to third decision methods described above, the set value is decided by calculating the average value of the full numbers in the full states of a plurality of times. As a method of deciding the set value by using the average value, for example, the average value itself may be the set value, or a value obtained by adding or subtracting a predetermined value to a reference value which is the average value may be the set value.

As a concrete example, for example, in country and region where the handling of the banknote is rough, the number of folds and bends of the banknote tend to increase, and the number of banknotes storable in the storage unit tends to decrease. In such a case, the set value can be reduced by deciding the set value by subtracting a predetermined value from the reference value which is the average value. In this manner, the set value can be appropriately adjusted depending on the installation location of the banknote processing apparatus 1, and therefore, it is more preferable.

In the first to third decision methods, the set value of the storage unit containing the same storage mechanism is decided based on the count result information and the storage unit full information obtained from the plurality of storage units containing the same storage mechanism. Alternatively, the decision unit 112 may estimate the set values of the plurality of storage units containing another storage unit different from the one storage unit, based on the count result information and the storage unit full information obtained from the plurality of storage units containing the one storage unit. Specific examples will be described. For example, it is assumed that it is known in advance that the capacity of a certain storage unit is C times the capacity of another storage unit. In this case, the decision unit 112 may decide the set value of another storage unit by multiplying the average value of the full numbers by C, the average value being calculated by using the count result information and the storage unit full information obtained from the plurality of the certain storage units. By such a method, it is more preferable because it is possible to use the set value between a plurality of storage units comprising different storage mechanisms, and the calculation amount is reduced.

(Shifted Banknote Rejection Function)

In the following, the shifted banknote rejection function in the banknote processing apparatus 1 will be described.

When the banknote is deposited in the deposit unit 21, the banknote may be deposited in a state which the banknote is not near the center of the inlet 211 but is shifted to either of the left or right, because the width of the inlet 211 is sufficiently larger than that of the banknote. Note that, in the present embodiment, the left and right refer to the left and right in a state where is directly faced to the banknote processing apparatus 1 from the front side of the banknote processing apparatus 1.

The banknote deposited from the inlet 211 is transported by the transport unit 4 to the storage devices 31 to 35 or the temporary storage unit 24. When the banknote deposited from the inlet 211 is shifted from the center to either of the left and right, the transport unit 4 transports the banknote in the state which the banknote is shifted to either of the left or right. When the banknote is stored in the storage devices 31 to 35 or the temporary storage unit 24, the banknote is stored in a state of being shifted to either of the left or right.

In this manner, when the banknote is stored in a state of being shifted from the center to either of the left or right, the following problem may occur. When the banknote in a state of being shifted to either of the left or right is about to be stored in the stacking type storage unit comprised by the storage devices 31 to 35, stacking the banknotes in the storage unit may not be preferably performed, or feeding out may not be suitably performed when the banknote is fed out from the storage unit. In addition, when the banknote in a state of being shifted to either the left or right is stored in the tape-type storage unit comprised by the temporary storage unit 24, the banknote may not be sufficiently caught by the tape, and the tape may be damaged due to loosening of the tape.

In order to avoid such a situation, in the deposit processing, the banknote processing apparatus 1 comprises the shifted banknote rejection function for rejecting the shifted banknote when the banknote deposited in the inlet 211 is shifted from the center to either of the left or right by a predetermined distance or more. Whether or not the banknote is shifted from the center to either the left or right by the predetermined distance or more is recognized by the recognition unit 25. The recognition unit 25 may calculate the distance by which the banknote is shifted from the center to either of the left or right, and the controller 15 may determine whether or not the distance calculated by the recognition unit 25 is equal to or greater than a predetermined distance.

The shifted banknote rejection function is realized as follows. First, the banknote processing apparatus 1 recognizes the banknote deposited in the inlet 211 by the recognition unit 25, and recognizes whether or not the banknote is shifted from the center to either of the left or right by the predetermined distance or more. Among the banknote deposited in the inlet 211, the deposit processing is normally executed for the banknote whose distance shifted from the center to either of the left or right is less than the predetermined distance.

The banknote processing apparatus 1 sorts the extracted banknote according to whether they are shifted from the center to the left or right by the predetermined distance or more. Then, the banknote processing apparatus 1 transports the banknote shifted to the right by the predetermined distance or more to either one of the outlet 221 of the dispense unit 22 of the second outlet 231 of the rejection unit 23 in a state where the banknote is shifted to the right to reject the banknote. In addition, the banknote processing apparatus 1 transports the banknote shifted to the left by the predetermined distance or more to another of the outlet 221 of the dispense unit 22 of the second outlet 231 of the rejection unit 23 in a state where the banknote is shifted to the left to reject the banknote.

By such a function, only the banknote which is shifted to, for example, the right by the predetermined distance or more is rejected to the outlet 221 of the dispense unit 22. On the other hand, only the banknote which is shifted to, for example, the left by the predetermined distance or more is rejected to the second outlet 231 of the rejection unit 23. Needless to say, the banknote which is shifted to the left may be rejected to the outlet 221, and the banknote which is shifted to the right may be rejected to the second outlet 231.

In this manner, only the banknote in the state of being shifted to either of the left or right is rejected to the outlet 221 and the second outlet 231. The banknote rejected to the outlet 221 and the second outlet 231 is in a collected state to some extent, because the banknote is shifted either of the left or right. Therefore, when the operator grasps the rejected banknotes from the outlet 221 or the second outlet 231 and re-deposits the banknotes into the inlet 211, it is expected that the re-deposited banknotes are in a collected state to some extent and is not in a state of being separated from the left and right.

Therefore, according to the banknote processing apparatus 1 comprising the shifted banknote rejection function, it is expected that the re-deposited banknotes are in the collected state to some extent, by rejecting the banknote of being shifted to either of the left or right at the time of rejection to different outlet. Thus, by repeating the execution of the shifted banknote rejection function several times in the deposit processing, even when the operator does not particularly perform the work of aligning the banknotes, the rejected banknotes gradually become gathered in the vicinity of the center, and the number of the rejected banknotes can be gradually reduced.

When re-depositing, the operator may intentionally arrange the rejected banknotes in a state in which the banknotes are shifted to either of the left or right. In such a case, the banknote processing apparatus 1 rejects the banknotes shifted to either of the left or right while keeping the banknotes in an unchanged state. At this time, the banknote processing apparatus 1 may display a message such as "Please align banknotes in the center" on the display 210. By such an operation, the operator can know that the banknotes should be deposited near the center of the inlet 211 in the collected state, and a situation in which the banknotes are shifted to either of the left or right in the subsequent deposit processing by the operator can be reduced.

Such a shifted banknote rejection function is particularly effective when, for example, the banknotes whose size differs greatly depending on denominations are deposited in a state in which various denominations are mixed.

<Effects>

As described above, the banknote processing apparatus 1 (the banknote processing system 100) according to the embodiment of the present disclosure comprises at least one storage unit for storing a sheet, at least one counter unit 151 for counting the number of sheets stored in the storage unit, a determination unit 152 for determining whether the storage unit is full based on storage state of the storage unit, a decision unit 153 (112) for deciding a set value relating to an upper limit number of sheets storable in the storage unit by using a plurality of count results from the counter unit 151 at a point in time when the determination unit 152 determines that the storage unit is full, and a setting unit 154 for setting the set value decided by the decision unit 153 (112) as a set value of the storage unit.

Thus, in the banknote processing apparatus 1 (the banknote processing system 100) according to the embodiment of the present disclosure, since the set value for regarding that the storage unit is full is decided by using a plurality of count results, the set value can be made more appropriate value.

For example, in a banknote processing apparatus adopting a method of deciding a set value by a method of deciding the set value as the past full number itself, for example, when the banknotes with many wrinkles or bends are temporarily stored in a large amount and the storage unit becomes in a full state, a set value that is much smaller than, for example, the full number when new series notes are stored is decided. Further, in the banknote processing apparatus adopting the method of deciding the set value by the method of deciding the set value as the past full number itself, when the full state is erroneously detected due to the abnormality of the storage unit or the determination unit 152, the set value is also decided as the abnormal value.

However, in the banknote processing apparatus 1 (the banknote processing system 100) according to the embodiment of the present disclosure, since the set value is decided based on the full numbers in the full state of a plurality of times, it is possible to avoid such a situation, and it is possible to decide the set value to a more appropriate value.

(Other Embodiments)

In the above embodiment, the storage state of the storage unit is detected by detecting the position of the stage 55 by the detection sensor 71, however, it is not limited thereto. For example, the position of stage 55 may be detected by monitoring the operation of the drive means driving the stage. Further, the position of the stage 55 may be detected by the camera photographing the inside of the storage space containing the stage 55. In addition, the storage state of the storage unit may be a state of banknote stored in the storage unit. The state of the banknote may be a height of banknotes stacked and stored in the storage unit. For example, the height of the banknote may be detected by the camera photographing the inside of the storage space containing the stacked banknotes.

Figure 8:
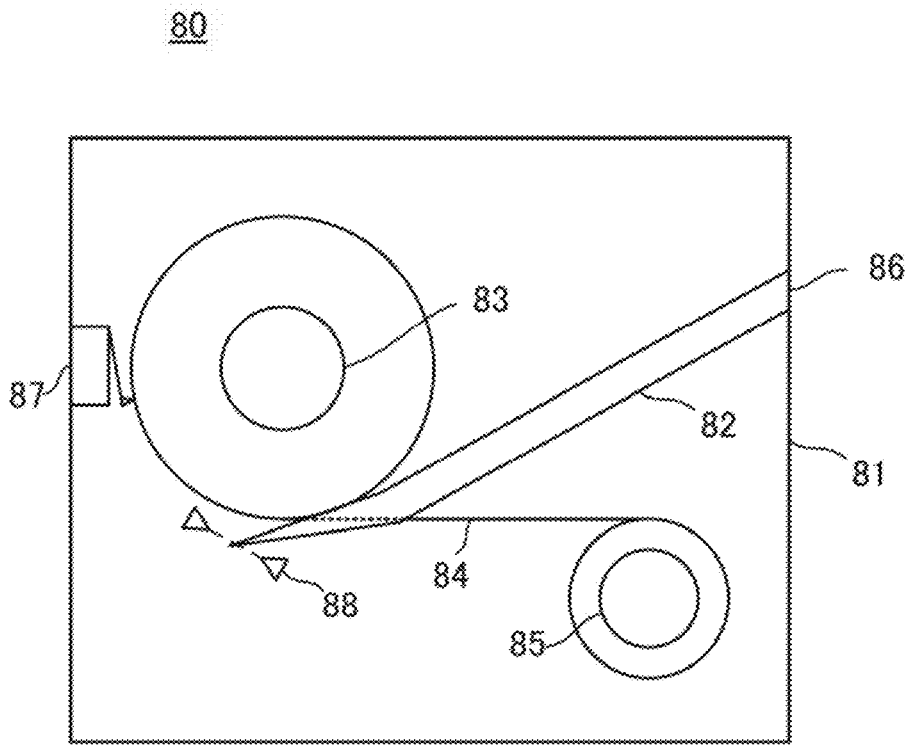
FIG. 8 is a diagram illustrating an exemplary tape-type storage unit.

The storage unit may be a tape-type storage unit that stores the banknote by winding the banknote together with the tape on a drum. FIG. 8 is a diagram illustrating an example of the configuration of the tape-type storage unit 80. As illustrated in FIG. 8, the tape-type storage unit 80 comprises a housing 81, a transport guide 82, a drum 83, a tape 84, and a reel 85.

A passage port 86 through which the banknote passes is provided in a part of the housing 81. The transport guide 82 configures a transport path for transporting the banknote in both directions between the passage port 86 and the drum 83. One end of the tape 84 is connected to the drum 83. The tape 84 is formed in a belt shape. The other end of the tape 84 is connected to the reel 85. That is, the tape 84 is wound by the drum 83 or the reel 85.

When the tape-type storage unit 80 stores the banknote, the tape 84 is wound by the drum 83. At this time, the banknote transported from the passage port 86 by the transport guide 82 is wound up together with the tape 84. As a result, the drum 83 stores the banknote. The end of the transport guide 82 on the drum 83 side is in contact with the banknote or tape 84 stored in the drum 83, and swings according to the number of the banknote stored in the drum 83.

On the other hand, when the tape-type storage unit 80 discharges the banknote, the tape 84 is wound by the reel 85. At this time, the banknote is transported from the tape 84 to the passage port 86 by the transport guide 82, and is discharged to the outside of the tape-type storage unit 80 from the passage port 86.

Sensors 87 and 88 are provided to detect the storage condition of the drum 83. The sensors 87, 88 are sensors for detecting that the drum 83 takes up the tape 84 with the banknote as much as possible, in other words, that the tape-type storage unit 80 is full. The sensor 87 detects that the outer diameter of the drum 83 is maximized. The sensor 88 detects the position of the transport guide 82 in contact with the drum 83 in a state where the outer diameter is maximized. In the example illustrated in FIG. 8, the tape-type storage unit 80 is illustrated to comprise two sensors of the sensor 87 and the sensor 88, in practice, the tape-type storage unit 80 may be provided with only one of the sensors. Further, instead of the sensors 87 and 88, the tape-type storage unit 80 may be detected that it is in the full state by detecting the outer diameter of the drum 83 wound up the banknote and tape 84, or the position of the transport guide 82, by using a camera.

Figure 9:
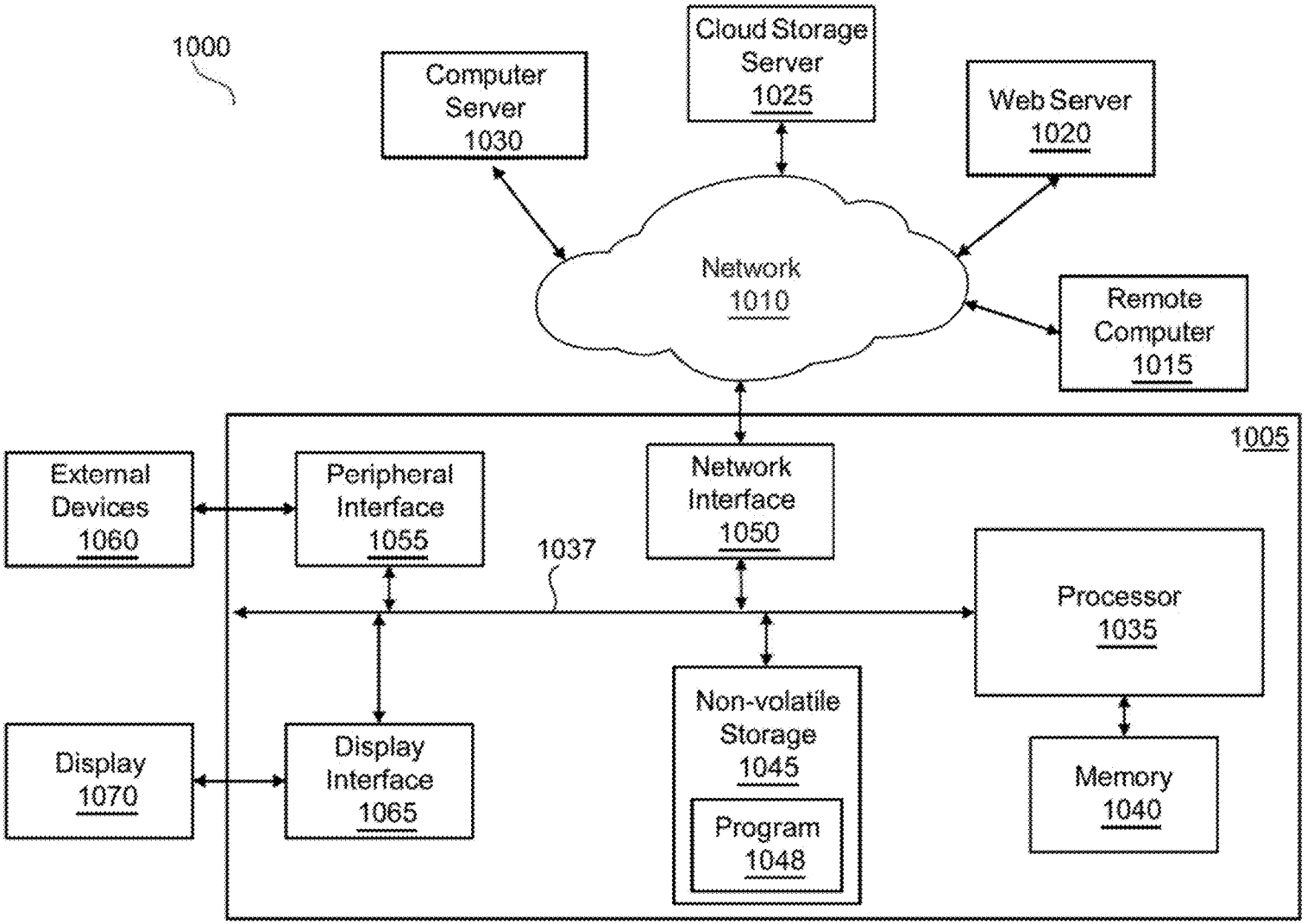
FIG. 9 is a block diagram of computer-based circuitry that may be used to implement control features of the present disclosure.

FIG. 9 illustrates a block diagram of a computer that may implement the various embodiments described herein. The present disclosure may be embodied as a system, a method, and/or a computer program product. The computer program product may include a non-transitory computer readable storage medium on which computer readable program instructions are recorded that may cause one or more processors to carry out aspects of the embodiment. For example, controller 15 and its individual components as well as attached components may be configured to include various elements depicted in FIG. 9.

The non-transitory computer readable storage medium may be a tangible device that can store instructions for use by an instruction execution device (processor). The computer readable storage medium may be, for example, but is not limited to, an electronic storage device, a magnetic storage device, an optical storage device, an electromagnetic storage device, a semiconductor storage device, or any appropriate combination of these devices. A non-exhaustive list of more specific examples of the computer readable storage medium includes each of the following (and appropriate combinations): flexible disk, hard disk, solid-state drive (SSD), random access memory (RAM), read-only memory (ROM), erasable programmable read-only memory (EPROM or Flash), static random access memory (SRAM), compact disc (CD or CD-ROM), digital versatile disk (DVD) and memory card or stick. A computer readable storage medium, as used in this disclosure, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described in this disclosure can be downloaded to an appropriate computing or processing device from a computer readable storage medium or to an external computer or external storage device via a global network (i.e., the Internet), a local area network, a wide area network and/or a wireless network. The network may include copper transmission wires, optical communication fibers, wireless transmission, routers, firewalls, switches, gateway computers and/or edge servers. A network adapter card or network interface in each computing or processing device may receive computer readable program instructions from the network and forward the computer readable program instructions for storage in a computer readable storage medium within the computing or processing device.

Computer readable program instructions for carrying out operations of the present disclosure may include machine language instructions and/or microcode, which may be compiled or interpreted from source code written in any combination of one or more programming languages, including assembly language, Basic, Fortran, Java, Python, R, C, C++, C# or similar programming languages. The computer readable program instructions may execute entirely on a user's personal computer, notebook computer, tablet, or smartphone, entirely on a remote computer or compute server, or any combination of these computing devices. The remote computer or compute server may be connected to the user's device or devices through a computer network, including a local area network or a wide area network, or a global network (i.e., the Internet). In some embodiments, electronic circuitry including, for example, programmable logic circuitry, field-programmable gate arrays (FPGA), or programmable logic arrays (PLA) may execute the computer readable program instructions by using information from the computer readable program instructions to configure or customize the electronic circuitry, in order to perform aspects of the present disclosure.

Aspects of the present disclosure are described herein with reference to flow diagrams and block diagrams of methods, apparatus (systems), and computer program products according to embodiments of the disclosure. It will be understood by those skilled in the art that each block of the flow diagrams and block diagrams, and combinations of blocks in the flow diagrams and block diagrams, can be implemented by computer readable program instructions.

The computer readable program instructions that may implement the systems and methods described in this disclosure may be provided to one or more processors (and/or one or more cores within a processor) of a general purpose computer, special purpose computer, or other programmable apparatus to produce a machine, such that the instructions, which execute via the processor of the computer or other programmable apparatus, create a system for implementing the functions specified in the flow diagrams and block diagrams in the present disclosure. These computer readable program instructions may also be stored in a computer readable storage medium that can direct a computer, a programmable apparatus, and/or other devices to function in a particular manner, such that the computer readable storage medium having stored instructions is an article of manufacture including instructions which implement aspects of the functions specified in the flow diagrams and block diagrams in the present disclosure.

The computer readable program instructions may also be loaded onto a computer, other programmable apparatus, or other device to cause a series of operational steps to be performed on the computer, other programmable apparatus or other device to produce a computer implemented process, such that the instructions which execute on the computer, other programmable apparatus, or other device implement the functions specified in the flow diagrams and block diagrams in the present disclosure.

FIG. 9 is a functional block diagram illustrating a networked system 1000 of one or more networked computers and servers. In an embodiment, the hardware and software environment illustrated in FIG. 9 may provide an exemplary platform for implementation of the software and/or methods according to the present disclosure.

Referring to FIG. 9, a networked system 1000 may include, but is not limited to, computer 1005, network 1010, remote computer 1015, web server 1020, cloud storage server 1025 and compute server 1030. In some embodiments, multiple instances of one or more of the functional blocks illustrated in FIG. 9 may be employed.

Additional detail of computer 1005 is shown in FIG. 9. The functional blocks illustrated within computer 1005 are provided only to establish exemplary functionality and are not intended to be exhaustive. And while details are not provided for remote computer 1015, web server 1020, cloud storage server 1025 and compute server 1030, these other computers and devices may include similar functionality to that shown for computer 1005.

Computer 1005 may be a personal computer (PC), a desktop computer, laptop computer, tablet computer, netbook computer, a personal digital assistant (PDA), a smart phone, or any other programmable electronic device capable of communicating with other devices on network 1010.

Computer 1005 may include processor 1035, bus 1037, memory 1040, non-volatile storage 1045, network interface 1050, peripheral interface 1055 and display interface 1065. Each of these functions may be implemented, in some embodiments, as individual electronic subsystems (integrated circuit chip or combination of chips and associated devices), or, in other embodiments, some combination of functions may be implemented on a single chip (sometimes called a system on chip or SoC).

Processor 1035 may be one or more single or multi-chip microprocessors, such as those designed and/or manufactured by Intel Corporation, Advanced Micro Devices, Inc. (AMD), Arm Holdings (Arm), Apple Computer, etc. Examples of microprocessors include Celeron, Pentium, Core i3, Core i5 and Core i7 from Intel Corporation; Opteron, Phenom, Athlon, Turion and Ryzen from AMD; and Cortex-A, Cortex-R and Cortex-M from Arm.

Bus 1037 may be a proprietary or industry standard high-speed parallel or serial peripheral interconnect bus, such as ISA, PCI, PCI Express (PCI-e), AGP, and the like.

Memory 1040 and non-volatile storage 1045 may be computer-readable storage media. Memory 1040 may include any suitable volatile storage devices such as Dynamic Random Access Memory (DRAM) and Static Random Access Memory (SRAM). Non-volatile storage 1045 may include one or more of the following: flexible disk, hard disk, solid-state drive (SSD), read-only memory (ROM), erasable programmable read-only memory (EPROM or Flash), compact disc (CD or CD-ROM), digital versatile disk (DVD) and memory card or stick.

Program 1048 may be a collection of machine readable instructions and/or data that is stored in non-volatile storage 1045 and is used to create, manage and control certain software functions that are discussed in detail elsewhere in the present disclosure and illustrated in the drawings. In some embodiments, memory 1040 may be considerably faster than non-volatile storage 1045. In such embodiments, program 1048 may be transferred from non-volatile storage 1045 to memory 1040 prior to execution by processor 1035.

Computer 1005 may be capable of communicating and interacting with other computers via network 1010 through network interface 1050. Network 1010 may be, for example, a local area network (LAN), a wide area network (WAN) such as the Internet, or a combination of the two, and may include wired, wireless, or fiber optic connections. In general, network 1010 can be any combination of connections and protocols that support communications between two or more computers and related devices.

Peripheral interface 1055 may allow for input and output of data with other devices that may be connected locally with computer 1005. For example, peripheral interface 1055 may provide a connection to external devices 1060. External devices 1060 may include devices such as a keyboard, a mouse, a keypad, a touch screen, and/or other suitable input devices. External devices 1060 may also include portable computer-readable storage media such as, for example, thumb drives, portable optical or magnetic disks, and memory cards. Software and data used to practice embodiments of the present disclosure, for example, program 1048, may be stored on such portable computer-readable storage media. In such embodiments, software may be loaded onto non-volatile storage 1045 or, alternatively, directly into memory 1040 via peripheral interface 1055. Peripheral interface 1055 may use an industry standard connection, such as RS-232 or Universal Serial Bus (USB), to connect with external devices 1060.

Display interface 1065 may connect computer 1005 to display 1070. Display 1070 may be used, in some embodiments, to present a command line or graphical user interface to a user of computer 1005. Display interface 1065 may connect to display 1070 using one or more proprietary or industry standard connections, such as VGA, DVI, DisplayPort and HDMI.

As described above, network interface 1050, provides for communications with other computing and storage systems or devices external to computer 1005. Software programs and data discussed herein may be downloaded from, for example, remote computer 1015, web server 1020, cloud storage server 1025 and compute server 1030 to non-volatile storage 1045 through network interface 1050 and network 1010. Furthermore, the systems and methods described in this disclosure may be executed by one or more computers connected to computer 1005 through network interface 1050 and network 1010. For example, in some embodiments the systems and methods described in this disclosure may be executed by remote computer 1015, computer server 1030, or a combination of the interconnected computers on network 1010.

Data, datasets and/or databases employed in embodiments of the systems and methods described in this disclosure may be stored and or downloaded from remote computer 1015, web server 1020, cloud storage server 1025 and compute server 1030.

The present disclosure can be applied to a banknote processing apparatus and a banknote processing system for storing the banknote.

The invention claimed is:

1. A sheet processing system, comprising:

a storage device that stores one or more sheets; and control circuitry configured to:

count a number of sheets stored in the storage device;

determine whether the storage device is full based on a storage state of the storage device;

calculate an average value of a plurality of count results at a point in time in which the control circuitry determines that the storage device is full;

decide, based on the average value, a set value relating to an upper limit number of the sheets storable in the storage device; and set the set value for the storage device.

2. The sheet processing system according to claim 1, wherein the control circuitry decides the set value by using the plurality of the count results of the counting performed at times different from each other.

3. The sheet processing system according to claim 1, further comprising a plurality of storage devices, wherein the plurality of storage devices include the storage device, and the control circuitry decides the set value of at least one of the plurality of storage devices, using the plurality of count results of the plurality of storage devices.

4. The sheet processing system according to claim 3, wherein the plurality of storage devices each store a sheet included in a same category.

5. The sheet processing system according to claim 4, wherein the sheet is a banknote, and the category is a category defined based on at least one of a denomination, a fitness, and a storage posture.

6. The sheet processing system according to claim 3, wherein the control circuitry decides the set value of the storage device whose use satisfies a first condition, by using at least one of the plurality of count results acquired from the plurality of storage devices, and a use for each of the plurality of storage devices satisfies the first condition.

7. The sheet processing system according to claim 1, wherein the storage device comprises a first storage unit with a first storage mechanism and a second storage unit with a second storage mechanism different from the first storage mechanism, and the control circuitry decides a first set value of the first storage unit by using at least one of the plurality of count results of the first storage unit, and decides a second set value of the second storage unit by using at least one of the plurality of count results of the second storage unit.

8. The sheet processing system according to claim 1, wherein the control circuitry decides the set value by using the plurality of count results accumulated in a specific period.

9. The sheet processing system according to claim 1, wherein the storage state is a state of the sheet stored in the storage device.

10. The sheet processing system according to claim 9, wherein the state of the sheet is a height of the sheets stacked and stored in the storage device, and the control circuitry determines whether the storage device is full based on the height of the sheets.

11. The sheet processing system according to claim 1, wherein the storage state is a position of a component of the storage device.

12. The sheet processing system according to claim 11, further comprising a sensor for detecting the position of the component, wherein the control circuitry determines whether the storage device is full based on an output of the sensor.

13. The sheet processing system according to claim 1, further comprising a memory for memorizing the set value, wherein the control circuitry updates, at a predetermined time, the set value stored in the memory, by using the set value.

14. The sheet processing system according to claim 1, further comprising:

a display for displaying the set value; and an operation interface for receiving a selection input whether or not to use the displayed set value.

15. The sheet processing system according to claim 1, further comprising a plurality of sheet processing apparatuses, wherein each sheet processing apparatus of the plurality of sheet processing apparatuses includes a storage device and control circuitry corresponding to the storage device and the control circuitry, and the control circuitry decides the set value by acquiring the plurality of count results from the plurality of sheet processing apparatuses, and sets the set value for at least one of the plurality of sheet processing apparatuses.

16. The sheet processing system according to claim 15, wherein the control circuitry decides a common set value which is commonly used among the plurality of sheet processing apparatus, and sets the common set value for the plurality of sheet processing apparatuses.

17. The sheet processing system according to claim 15, wherein the control circuitry decides the set value by using at least one of the plurality of count results acquired from the plurality of sheet processing apparatuses, wherein an installation location for each of the plurality of sheet processing apparatuses satisfies a predetermined second condition, and sets the set value for at least one of the plurality of sheet processing apparatuses, wherein the installation location for the at least one of the plurality of sheet processing apparatuses satisfies the second condition.

18. A sheet processing method in a sheet processing system including a storage device that stores one or more sheets, the sheet processing method comprising:

counting a number of sheets stored in the storage device;

determining whether the storage device is full based on a storage state of the storage device;

calculating an average value of a plurality of count results at a point in time in which the control circuitry determines that the storage device is full;

deciding, based on the average value, a set value relating to an upper limit number of the sheets storable in the storage device; and setting the set value for the storage device.

19. A decision apparatus, comprising:

control circuitry configured to:

acquire a plurality of count results from a plurality of sheet processing apparatuses, each sheet processing apparatus including a storage device that stores one or more sheets and providing a count result of the one or more sheets stored in the storage device in response to a determination that the storage device is full;

calculates an average value of the plurality of count results; and decide, based on the average value, a set value relating to an upper limit number of the one or more sheets storable in the storage device.

* * * * *